US011034143B2

(12) United States Patent
Nader

(10) Patent No.: US 11,034,143 B2
(45) Date of Patent: Jun. 15, 2021

(54) SYSTEMS AND PROCESSES FOR PRODUCING PRODUCTS HAVING CARDS ATTACHED THERETO

(71) Applicant: John M. Nader, Valparaiso, IN (US)

(72) Inventor: John M. Nader, Valparaiso, IN (US)

( * ) Notice: Subject to any disclaimer, the term of this patent is extended or adjusted under 35 U.S.C. 154(b) by 829 days.

(21) Appl. No.: 14/863,708

(22) Filed: Sep. 24, 2015

(65) Prior Publication Data

US 2016/0207303 A1 Jul. 21, 2016

Related U.S. Application Data

(60) Provisional application No. 62/056,208, filed on Sep. 26, 2014, provisional application No. 62/096,035, filed on Dec. 23, 2014, provisional application No. 62/128,625, filed on Mar. 5, 2015.

(51) Int. Cl.

| | |
|---|---|
| ***B41F 19/00*** | (2006.01) |
| ***B42D 15/04*** | (2006.01) |
| ***B31D 1/00*** | (2017.01) |

(52) U.S. Cl.

CPC ..... *B41F 19/008* (2013.01); *B31D 1/0081* (2013.01); *B42D 15/042* (2013.01); *B42D 15/045* (2013.01)

(58) Field of Classification Search

CPC ..... B41F 19/008; B31D 1/008; B31D 1/027; B31D 1/0081; B42D 15/042; B42D 15/045; B42D 5/027; B41G 7/00; G09F 1/10; B32B 38/10; B32B 38/105

See application file for complete search history.

(56) References Cited

U.S. PATENT DOCUMENTS

| | | | | |
|---|---|---|---|---|
| 1,576,476 A * | 3/1926 | Whittier | D06C 13/04 | 26/10.4 |
| 2,289,796 A * | 7/1942 | Meyer | D05B 33/02 | 112/2 |
| 3,234,594 A * | 2/1966 | Winstead | B29C 51/267 | 156/501 |
| 3,583,888 A * | 6/1971 | Shanklin | B65B 51/303 | 53/568 |
| 3,888,150 A * | 6/1975 | Stroud | B23D 53/005 | 83/368 |
| 4,010,964 A * | 3/1977 | Schechter | B42D 15/042 | 229/70 |
| 4,046,368 A * | 9/1977 | LeBreton | B42C 19/00 | 40/124.09 |

(Continued)

*Primary Examiner* — Robert F Long
*Assistant Examiner* — Eduardo R Ferrero
(74) *Attorney, Agent, or Firm* — Hartman Global IP Law; Gary M. Hartman; Domenica N. S. Hartman

(57) ABSTRACT

Systems and processes for producing a product having a carrier and a card secured thereto. Such a process includes providing a blank having a card panel and carrier panel that are contiguous with a fold line therebetween. The process further includes cutting the card panel to at least partially define a partial cutout card therein such that a remaining portion of the card panel surrounds the partial cutout card, folding the card panel over and onto the carrier panel such that the partial cutout card is secured to the carrier panel with an adhesive, and then removing the remaining portion so that the remaining portion is separated from the partial cutout card, and the partial cutout card remains secured to the carrier panel and defines at least a portion of the card of the product.

31 Claims, 11 Drawing Sheets

(56) References Cited

U.S. PATENT DOCUMENTS 4,055,249 A * 10/1977 Kojima ..... B65D 73/0028 206/390
RE30,010 E * 5/1979 Shanklin ..... B65B 59/00 53/552
4,153,496 A * 5/1979 Swift ..... B31D 1/021 156/248
4,176,430 A * 12/1979 Anderson ..... D06C 3/02 198/693
4,200,222 A * 4/1980 Feuer ..... B42D 15/045 206/813
4,246,058 A * 1/1981 Reed ..... B26D 7/1827 156/183
4,379,573 A * 4/1983 Lomeli ..... B42C 3/00 283/81
4,405,401 A * 9/1983 Stahl ..... G09F 3/04 156/248
4,453,572 A * 6/1984 Key ..... D03D 45/62 139/291 C
4,778,153 A * 10/1988 Bachman ..... A63F 3/0665 229/92.8
4,868,027 A * 9/1989 Hunkeler ..... G09F 3/0289 428/42.3
4,885,859 A * 12/1989 Gasser ..... B42D 15/04 40/539
4,983,438 A * 1/1991 Jameson ..... B42D 5/023 283/101
5,056,827 A * 10/1991 Sasso ..... G09F 3/02 283/105
5,117,610 A 6/1992 Hartman et al.
5,172,938 A * 12/1992 Schmidt ..... B42D 5/025 283/105
5,217,775 A * 6/1993 v. Wedekind ..... G09F 3/0288 283/81
5,226,532 A * 7/1993 Davidson ..... B42D 15/045 206/232
5,232,147 A * 8/1993 Weinzierl ..... B42D 5/025 229/314
5,284,363 A * 2/1994 Gartner ..... G09F 3/10 283/101
5,324,153 A * 6/1994 Chess ..... B42D 5/025 156/250
5,467,573 A * 11/1995 Weder ..... A01G 5/04 53/397
5,472,240 A * 12/1995 Davies ..... B42D 15/042 156/250
5,472,756 A * 12/1995 Sechet ..... G09F 3/0288 428/343
5,507,901 A * 4/1996 Limina ..... B32B 37/1292 156/200
5,595,404 A * 1/1997 Skees ..... B42D 15/08 229/92.1
5,611,161 A * 3/1997 Murphy ..... B42D 15/042 116/321
5,705,243 A * 1/1998 Mehta ..... B42D 5/027 229/92
5,958,536 A * 9/1999 Gelsinger ..... G09F 3/0288 283/81
6,035,568 A * 3/2000 Grosskopf ..... B65D 23/003 40/630
6,103,040 A * 8/2000 Hunkeler ..... A45D 40/0087 156/226
6,213,303 B1 * 4/2001 Harris ..... A45D 37/00 132/320
6,214,153 B1 * 4/2001 Chess ..... B42D 25/00 156/253
6,293,592 B1 * 9/2001 Robertson ..... B42D 15/042 283/117
6,510,980 B2 * 1/2003 Halbrook, Jr. ..... B42D 15/08 229/80
6,533,325 B1 * 3/2003 Steidinger ..... G09F 3/0288 283/105
6,648,232 B1 * 11/2003 Emmert ..... G06K 19/041 235/488
7,073,704 B2 * 7/2006 Moore ..... B42D 15/08 229/92.3
7,231,750 B2 6/2007 Woodman et al.
7,254,931 B2 8/2007 Stemmle
7,300,044 B2 11/2007 Stemmle
7,964,228 B2 * 6/2011 Milliorn ..... B31D 1/021 206/459.1
8,120,811 B2 2/2012 Graushar et al.
8,376,345 B1 * 2/2013 Haydt, III ..... B65H 39/043 270/21.1
8,468,780 B2 6/2013 Woodman et al.
8,528,890 B2 9/2013 Graushar et al.
8,605,322 B2 12/2013 Barndt et al.
8,625,152 B2 1/2014 Graushar et al.
2002/0130510 A1 * 9/2002 Thompson ..... B42D 15/045 283/61
2003/0028439 A1 * 2/2003 Cox ..... B42D 15/045 40/124.191
2003/0067159 A1 * 4/2003 Ritchie ..... B42D 15/045 283/101
2003/0150142 A1 * 8/2003 Street ..... B42D 15/045 40/124.11
2004/0137199 A1 * 7/2004 Flynn ..... B65C 9/265 428/131
2004/0146688 A1 * 7/2004 Treat ..... B42D 15/042 428/78
2006/0011030 A1 * 1/2006 Wagner ..... B26F 1/20 83/343
2006/0145470 A1 * 7/2006 Holmberg ..... B42D 5/027 283/98
2006/0208044 A1 * 9/2006 Condon ..... B42D 15/042 229/92.8
2006/0249563 A1 * 11/2006 van Vugt ..... B42D 15/042 229/102.5
2007/0094901 A1 * 5/2007 Kibbe ..... B42D 15/045 40/124.06
2007/0116922 A1 * 5/2007 Holmberg ..... B42D 5/027 428/98
2008/0116088 A1 * 5/2008 Roberts ..... B42D 15/042 206/232
2008/0172145 A1 7/2008 Freyburger et al.
2008/0233327 A1 * 9/2008 Hudetz ..... B42D 15/045 428/43
2009/0107086 A1 4/2009 Keane et al.
2009/0241787 A1 * 10/2009 DiGenova ..... B41F 13/02 101/248
2010/0043354 A1 * 2/2010 Paltiel ..... G06T 11/60 53/411
2010/0095566 A1 * 4/2010 Gustafson, Jr. ..... B42D 15/042 40/124.01
2010/0187293 A1 * 7/2010 Mehta ..... B42D 15/045 229/92.8
2011/0084122 A1 * 4/2011 Rodgers ..... B32B 37/142 229/305
2011/0115209 A1 5/2011 Donahue
2011/0248493 A1 * 10/2011 Aronstein ..... B42D 15/042 283/116
2011/0253297 A1 * 10/2011 O'Keefe ..... B42D 5/027 156/230
2013/0094891 A1 * 4/2013 Annerstedt ..... B26D 9/00 400/621
2013/0227865 A1 * 9/2013 Mastalia ..... B42D 15/042 40/124.11
2014/0001694 A1 1/2014 Graushar et al.
2014/0021245 A1 * 1/2014 Burtch ..... B42D 15/045 229/70
2014/0104627 A1 4/2014 Graushar et al.
2014/0145424 A1 * 5/2014 Yost ..... B42D 15/045 283/66.2
2014/0168673 A1 6/2014 Barndt et al.

* cited by examiner

Continue to Step 301 of FIG. 6B

Continue to Step 301 of FIG. 6B

Continue to Step 308 of FIG. 9A

SYSTEMS AND PROCESSES FOR PRODUCING PRODUCTS HAVING CARDS ATTACHED THERETO

CROSS REFERENCE TO RELATED APPLICATIONS

This application claims the benefit of U.S. Provisional Application No. 62/056,208, filed Sep. 26, 2014, U.S. Provisional Application No. 62/096,035, filed Dec. 23, 2014, and U.S. Provisional Application No. 62/128,625, filed Mar. 5, 2015. The contents of these prior applications are incorporated herein by reference.

BACKGROUND OF THE INVENTION

The present invention generally relates to sheet products and processes therefor. This invention particularly relates to processes for producing sheet products comprising surface-mounted or applied single- or multi-ply cards attached to a single- or multi-page carrier manufactured from a single, fully-integrated contiguous paper blank, and to products formed thereby.

Demand has continued to grow for direct mail advertising. Direct mail, that is, advertising mail products that are directly addressed to the intended recipient, encompasses a wide variety of marketing materials, including brochures, catalogs, postcards, newsletters, and sales letters. These promotional products are designed to convey personalized purchase offers and information to postal or otherwise distributed recipients. In the direct mail advertising industry, there is a growing demand for high quality, standalone, personalized direct mail promotional products that provide customers with redeemable discount offers, loyalty promotions primarily used at point of purchase retail outlets, and/or embedded or non-embedded electronic labels/tags that enable the recipient to be immediately connected via a mobile phone or computer. Increasingly, these promotional products have non-trackable or trackable data usage measurements suitable for providing the direct mail purchasers with closed-loop data feedback regarding the success of their direct mail advertising campaigns.

FIGS. 1A through 1F represents nonlimiting examples of promotional products 10 that carry promotional add-ons, for example, paper cards 12 offering redeemable discounts or loyalty promotions, which are attached to a multi-page carrier 14. These promotional products 10 typically have high volume, direct mail advertising print formats widely used by commercial retail as high end promotional coupons, redemptions, or loyalty cards. As described hereinafter, promotional cards 12 and carriers 14 of this type are often manufactured by one of two general methods, one being web finished from a continuous fully, partially or non-preprinted web from a web printing press combined with inline or separate stand-alone "offline" web finishing systems, and the other being methods whereby pre-cut cards are individually tipped on, on-serted or placed onto a fully, partially or non-preprinted individual sheet "blank." Along with established web finishing methods in which cards and carriers are derived directly from a web, "tipping," "tip-on," "on-serting," and "pick and place" methods are widely used and popular methods to attach pre-cut individual cards onto either continuous webs or pre-cut individual carriers. These "card with carrier" manufactured promotional products 10 are some of the most popular and desirable formats in direct mail printing today.

Using preexisting inline or offline web printing and web finishing processes, any number of specialty functions can take place in concert during the manufacture of promotional products 10 of the types represented in FIGS. 1A-1F. In a typical inline web printing and finishing process used in the printing industry, one or more fully, partially or non-printed moving web materials pass through a series of printing units at high speeds to be fully or partially printed, dried, and cooled, during which as an immediate and continuous part of the printing process the web undergoes finishing operations such as variable data printing (inkjet), UV coating, folding, perforating, gluing, die cutting, and rotary cutting to produce products having a desired page format, enhancement, and length. The "offline" web finishing version process usually involves concluding web printing and web finishing during a separate, two-step process, wherein the web is printed and rewound as a roll to be later unwound as a pre-printed web into a web finishing line to conclude folding, perforating, gluing, die cutting and rotary cutting the web to final length.

As nonlimiting examples, FIGS. 2 and 3 schematically represent a web printing press 20 with an inline web finishing system 40 of types suitable for producing single-, double- or triple-ply paper products such as the promotional products 10 represented in FIGS. 1A-1F. Typically, such processes start with a white roll stock paper 22, often having a gloss or matte surface and a gauge of #50 to 10 pt. The paper 22 is then processed as a continuous web in the direction of travel indicated by arrows 18. Images are printed on the stock paper 22 using, for example, fixed repeat, web offset, flexography, rotogravure, inkjet, digital, and/or rotary lithography at stations 24 and 26. The lithograph uses an up/around plate attached to a printing press cylinder (not shown) to produce rotary, fixed images on the web in a repeatable pattern divisible between a plate repeat circumference and a desired final product length, typically having up to five or more repeat images. Wet ink is then heat-set or UV cured in a drying system 28. Afterward, the temperature of the web may be reduced and/or a surface protection material may be applied at a station 30. Heat-set, remoistenable adhesives, or aqueous coatings can also be applied at the station 26 or at any time immediately following printing. Pattern perforation or die cutting of the entire continuous web may be performed by a pattern perforation or die cutting system 32.

If the promotional cards 12 carried on the promotional products 10 are to be personalized for direct mailing, a variable data printing (VDP) system 34 including an inkjet system, a laser system, or the like may be used to apply personalized data to any portion of the entire web for each individual product 10 formed by the previous printing processes. The personalized data may include, for example, a recipient's name and address, a salutation/greeting, maps, etc., as requested by the direct mailing promotion campaign. The VDP system 34 may also be used to apply to what will later become the card portion of the finished product card 12 one or more inkjet or laser printed trackable barcodes such as but not limited to UPC, QR, numeric, etc., as rescan technology allows for data usage measurements. The VDP system 34 may be timed to mismatch the personalization data and the card 12 at this time since the web will be later separated, sent to different paths, and re-married in mismatched timing downstream in the web finishing system 40. Typically, UV cured or aqueous based coatings may next be applied while the web is wholly intact and still continuous. Many if not all of these processes are typical to the creation and manufacture of web fed paper promotional products.

Once all printing has been completed, the entire continuous web enters the inline web finishing system 40, which is represented with top and side views in FIG. 2. The finishing system 40 is represented as having a ribbon (or angle bar) deck station 42 where the web is slit in the running direction (arrow 18) into continuous ribbons 44 that may be of equal or unequal widths. Various suitable slitting means are known in the printing industry and can be used. In this representation, the ribbon deck station 42 also often serves to turn the web (ribbons) out ninety degrees relative to its entry into the inline web finishing system 40. For simplicity, the inline web finishing system 40 will initially be described as producing a single-ply paper product with reference to FIG. 2, and multi-ply cards and advanced carriers will be described with reference to FIGS. 3 and 4. In FIG. 2, the full web is slit or cut at the ribbon deck station 42 to exit the station 42 as two ribbons 44 (top view of the system 40), one of which is designated a card ribbon 46 and the other a carrier ribbon 48 (side view of the system 40), though it should be understood that the slitting operation is not limited to producing the two ribbons 44 represented in FIG. 2. As depicted in the side view of FIG. 2, the ribbons 46 and 48 are transferred at separate vertical levels so as to be one above the other within the finishing system 40, and as represented in the top view of FIG. 2 the ribbons 46 and 48 may be "shifted" or repositioned laterally for format page imposition. At this time, format determination is made for single- or multi-ply cards 12 as well as the carriers 14.

The single-ply card ribbon 46 is typically positioned as shown in FIG. 2 to be vertically above the carrier ribbon 48 to produce promotional cards "inline" from a web. The card ribbon 46 passes into and through a rotary die cutter 50, which is configured to match an overall web press circumference repeat directly or as a whole number multiple thereof. Die plates (not shown) of any shape or size may be mounted around the die cutting cylinder 52. A similarly sized anvil or back cylinder 54 is located below the die cutting cylinder 52 to provide a rigid interface capable of ensuring that the die cuts are of high, consistent quality. The card ribbon 46 passes between the cylinders 52 and 54 and a card pattern is die cut into the card ribbon 46 to produce a die cut card ribbon 56. The die plates may or may not contain slight ties or nicks on edges of blades on the die plates in order to perforate, rather than completely die cut, the card ribbon 46, which allows the cards 12 to be minimally and temporarily held inside the die cut card ribbon 56. The cylinders 52 and 54 are circumferentially timed to the printed image on the card ribbon 46 such that the shapes and sizes of the cards 12 correspond to an exact position on the card ribbon 46 to match the previously printed image on the web.

At the same time, the carrier ribbon 48 to which the cards 12 will be affixed is routed under the cylinders 52 and 54 and immediately directed by path rollers to meet as near as possible to an outgoing rotation point of the cylinders 52 and 54 and the die cut card ribbon 56 which is exiting the cylinders 52 and 54 with the die cut card pattern. On route to a marrying point of the carrier ribbon 48 and the die cut card ribbon 56, hot melt spot glue from a programmable pattern timed, high temperature, high pressure gluer nozzle 58 is applied to the carrier ribbon 48 at specific locations corresponding to an area, referred to in the art as a carrier specific page location, where each card 12 will be attached to its carrier 14 (which may be a single card or multiple cards 12 mounted to each carrier 14, as evident from FIGS. 1A-1F). The carrier ribbon 48 thereafter immediately meets the die cut card ribbon 56 on the same horizontal or vertical plane and are married together, that is, combined. The die cutter 50, the gluer nozzle 58, the die cut card ribbon 56, and the carrier ribbon 48 are adjusted for circumferential and lateral registration positioning to ensure correct timing between all of the ribbons 44 and finishing processes will correspond so that the content of the print images from the card 12 and the carrier 14 match, and to ensure that the die cut portions of the card ribbon 56 from which the cards 12 are defined will be circumferentially timed to meet the location of the hot melt glue spots on the carrier ribbon 48 in order to provide proper adherence of the cards 12 to the carrier ribbon 48.

After a card 12 carried by the die cut card ribbon 56 is glued to the carrier ribbon 48, the remainder of the die cut card ribbon 56 is separated from the carrier ribbon 48 and removed as waste 60. This may be performed with a suction or vacuum system 62 suitable for separating and pulling away the remaining card ribbon 56 through high velocity air flow that exceeds the velocity of the ribbons 56 and 48. The cards 12 remain on the carrier ribbon 48 and are held firmly in place by the hot melt glue spots which then set and bond. Any perforations in the die cut card ribbon 56, formed by the ties or nicks of the die plates to reduce a possibility of card fallout and loss during die cutting and or transfer of the die cut card ribbon 56 to the carrier ribbon 48, are ripped apart as surrounding card waste is separated and vacuumed away by the suction system 62 leaving the cards 12 secured to the carrier ribbon 48 to form a combined ribbon 64.

Stations 66 of the web finishing system 40 represent various other conventional processes that may be used to facilitate the folding of the combined ribbon 64 around the cards 12 in order to complete the width and page count for a postal-ready finished-size product format desired by a print buyer. A rotary cutter-type machine 68 produces a final cut off length on the combined ribbon 64, which determines the final overall desired product length that matches the image lengths printed into postal-ready finished size. A shingling station 70 performs shingled delivery stacking of the products (that is, the promotional products 10) to maintain postal address delivery sequence or at least to provide a general postal sortation requirement.

To produce multi-ply cards, the process of die cutting and merging one or more card ribbons 46 to the carrier ribbon 48 with hot melt spot glue and subsequent waste removal remains essentially the same in concept. Differences generally include the creation of modified or additional ribbons from the web, as represented with two alternative web finishing systems 40 depicted in FIG. 3. For instance, double-ply cards 12 require that a relatively wider card ribbon 72 exits the ribbon deck station 42, instead of the narrower card ribbon 46 represented in FIG. 2. One-half of the width of the wider card ribbon 72 may be pattern glued by a gluing device 74, and then immediately folded in half upon itself by a plow folding device 76 to create a two-ply card ribbon 46 (two paper thickness) before entering the die cutter 50. If a triple-ply card 12 is desired, an additional relatively narrower card ribbon 78 of unprinted, white paper may be produced at the ribbon deck station 42, shifted into a lateral position, and merged into or sandwiched between portions of the wider card ribbon 72, as represented in FIG. 4. In this case, the entire surface of the wider card ribbon 72 is glued by the gluing device 74 and the narrower card ribbon 78 is merged from above onto one side of the glued wider card ribbon 72. The merged card ribbons 72 and 74 next pass through the plow folding device 76 which folds the remaining single panel portion of the wider card ribbon 72 over the narrower card ribbon 78 and the remaining half of the wider card ribbon 72 to create a triple thickness card ribbon 46 before entering the die cutter 50. The remainder of the web finishing systems 40 depicted in FIGS. 3 and 4 may be the same as that described for FIG. 2, and therefore will not be repeated here.

As evident from FIGS. 1A-1F, more than one carrier ribbon 48 may be used to produce promotional products 10, and the resulting carriers 14 may include many varieties of panel folds to create additional advertising page formats. The configuration of a carrier 14 is often and generally limited by the overall web width from the printing press 20 and perhaps equally so the weight of the final product and cost for postal delivery based on weight.

It will be appreciated by those skilled in the art that the above-described printing processes include a very intense series of processes that require mastery of the operational art along with extensive "make-ready" times, a term of art that refers to the process of setting up a printing system before running a job. The make-ready requirements of the above-described printing processes also result in paper waste during make-ready, which in addition to running (operational) paper waste during production runs result in costs to print buyers that are prohibitive at lesser volumes, reducing the availability of direct mail products.

Additional conventional techniques for producing promotional products of the type represented in FIGS. 1A-1F include creation of individualized cards 12 from paper or PVC (plastic), which can be added to a running inline or offline web finishing process or more popularly onto individual separated conveyed pieces from a variety of mailing machines available to the mailing/finishing/fulfillment industry segment. Such cards 12 are attached to their carriers 14 during the finishing process by such methods as "on-serting," "on-setting," "tip-on," "tipping," "affixing," and/or "pick and place" techniques using dedicated machines or feeders for in-time "tip-on" placement of the cards 12 to the carriers 14 (a web or individual piece) conveyed below the machine or feeder. However, these methods also provide significant limitations and negative aspects. For example, relative to paper cards, plastic cards often have higher material costs, are more costly to print, are of differing paper or print quality, are of differing color match, and cannot be printed on a back side after being attached to the web carrier sheet or blank, as well as other well-known limitations. In addition, these methods typically involve a multi-step process to complete finished card/carrier formats, including but not limited to separate printing of carriers 12; separate printing of cards; separate cutting of carriers to final size; separate die cutting and matrix removal around cards; sometimes separate process for VDP onto cards; all resulting in costly additional processes and handling. Regardless of the manufacturing method (e.g., continuous web/ribbon processes, web tip-on; or sheet/blank tip-on methods), in all known existing production circumstances, cards are always completely and physically separated from carriers at some point during the process which results in additional finishing sequences, steps, handling, limitations to product design, and a potential for circumferential and lateral misregistration and graphics mismatch of the card 12 to carrier 14, as well as speed reduction in finishing. However, most significant errors are likely to occur from the potential disruption of the postal sortation sequence to mailing order and customer receipt of mismatched data and information. The latter issues always demand investment for expensive camera verification technology to "read/write" VDP sequences during reassembly of the card to carrier to ensure data match and sequencing for client and product recipient.

In view of the above, it can be appreciated that there are certain problems, shortcomings or disadvantages associated with direct mail products that carry promotional cards, and that it would be desirable if systems and processes were available that were capable of at least partly reducing the complexity of the manufacturing process, reducing make-ready time, and reducing waste common to conventional manufacturing processes typically used to produce such direct mail products.

BRIEF DESCRIPTION OF THE INVENTION

The present invention provides systems and manufacturing processes suitable for producing products comprising surface-mounted or surface-applied single- or multi-ply cards attached to a single- or multi-page carrier manufactured from a single, fully-integrated blank (fully, partially or non-preprinted). The processes provide for reduced complexity of the manufacturing process, reduced make-ready times, and reduced waste relative to conventional manufacturing processes for producing comparable products.

According to one aspect of the invention, a process of manufacturing a finished, mail-ready product having a carrier and at least one card secured thereto includes providing a single, individual, contiguous blank having images or text printed thereon and at least first card panel and a first carrier panel that are contiguous with a fold line therebetween. The process further includes cutting the first card panel to at least partially define a first partial cutout card area therein such that the first partial cutout card remains partially attached area to the first card panel and a first remaining portion of the first card panel surrounds the first partial cutout card, folding the first card panel over and onto the first carrier panel such that the first partial cutout card is secured to the first carrier panel with an adhesive, and removing the first remaining portion of the first card panel so that the first remaining portion is separated from the first partial cutout card, the first partial cutout card remains secured to the first carrier panel and defines at least a portion of the card of the product, and the first carrier panel defines at least a portion of the carrier of the product. The card and carrier are never physically separate or out of contact with one another throughout the process.

According to another aspect of the invention, a system for producing a product having a carrier and at least one card secured thereto includes means for performing each of the steps of the process described above.

A technical effect of the invention is the ability to manufacture products having one or more single or multi-ply cards secured to a single or multi-ply carrier, wherein the carrier and the card(s) attached thereto can be produced from a single integral blank, as opposed to a continuous web. In particular, it is believed that, by forming the card and the carrier from the same integral blank with the card being secured in some manner to the carrier at all times in the manufacturing process, any images, text, personalized data, or other printings on the carriers and the cards will match without the need of any camera system, verification equipment, or other tracking or timing techniques, which are ordinarily required by conventional web printing techniques and any other processes that involve separated cards and carriers, therefore requiring matching and combining cards and carriers in later stages of the manufacturing process.

Other aspects and advantages of this invention will be better appreciated from the following detailed description.

DETAILED DESCRIPTION OF THE INVENTION

Figure 1A:
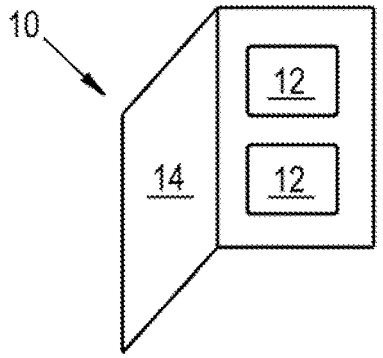
FIGS. 1A-1F represents promotional products having a variety of direct mail formats and cards of various shapes, sizes, and configurations attached thereto.
Figure 1B:
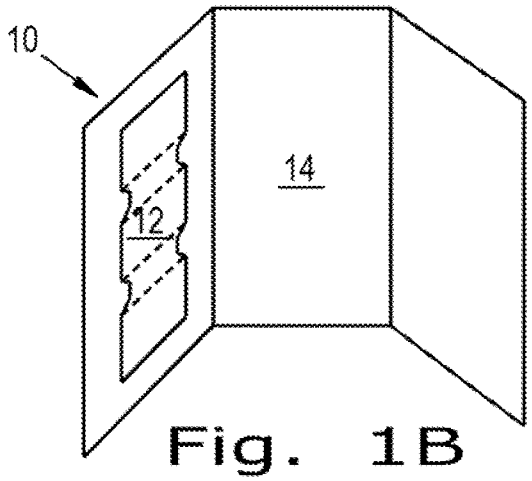
Figure 1C:
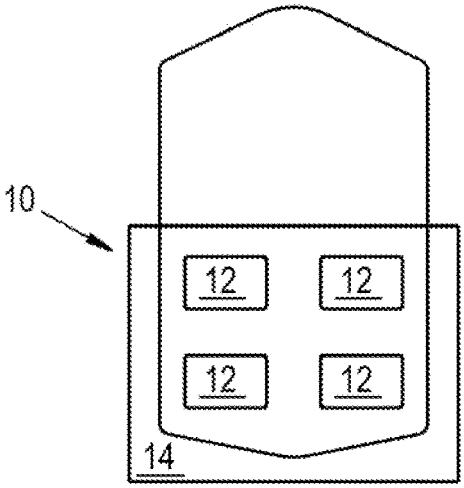
Figure 1D:
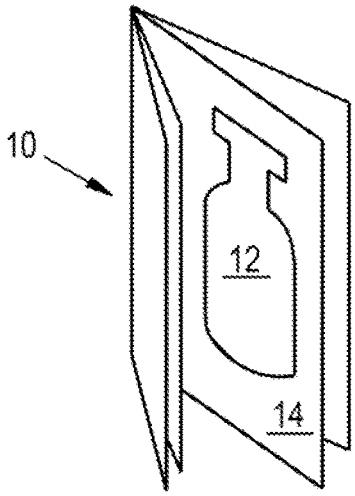
Figure 1E:
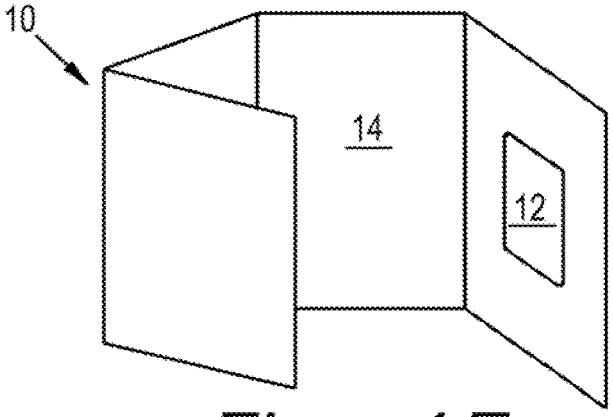
Figure 1F:
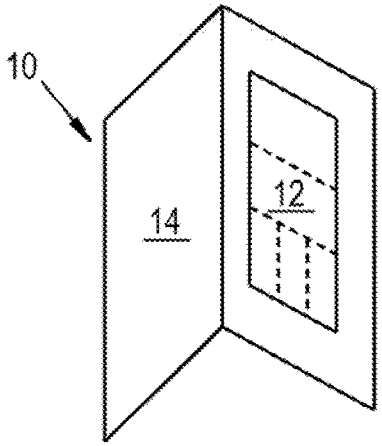

The present invention generally provides manufacturing processes for producing single- and multi-ply products that may be of essentially any size, quantity, and shape. The products include a carrier having one or more cards secured thereto that differ in size from the carrier, and each product is preferably individually produced entirely from a single, individual, fully integrated (contiguous) blank (i.e., substrate) that optionally may be partially or fully preprinted from any conceivable print engine source to have images pre-printed thereon. Products produced by the processes described herein may optionally include individual personalized data for recipient personalization and postal delivery sequencing directly on or across any or all parts of the blank. Notably, cards and carriers of the products are produced from the single blank and are never physically separated from the blank during the manufacturing process.

According to certain aspects of the invention, the manufacturing processes described hereinafter are capable of substantially replicating promotional (direct mail) products produced from paper, including those represented in FIGS. 1A-1F that were previously produced by conventional web press/inline/offline finishing processes such as those represented in FIGS. 2 through 4, as well as a large variety of other equipment and processes capable of on-serting, on-setting, tip-on, tipping, affixing, and/or pick and place techniques commonly employed to attach separated individual cards to carriers. Generally, such promotional products can be produced using a system having aspects in common with folder/gluer lines of the type used in the folding carton box converting industry to finish promotional products. In addition, such promotional products can be produced from high quality printing materials by processes that can be configured to maximize efficiency, time, and/or cost savings while reducing waste relative to conventional methods. The manufacturing processes described herein are further believed to address a growing print buyer demand for production of highly value-added promotional products at reduced quantities by providing for lower quantity runs at reduced cost relative to conventional methods.

While the invention is particularly well suited for producing promotional products for reasons as described above and will be discussed below in reference to such products, the invention is not limited to promotional products or to any particular material from which such products may be produced. In particular, though the invention will be described hereinafter in reference to promotional products of types generally used for direct mail advertising campaigns, it will be appreciated that aspects of the present invention are directly applicable to a variety of other products such as, but not limited to, post cards, greeting cards, and cards used for playing, trading, collecting, and games. For example, processes disclosed herein may be used to produce single- and multi-ply trading cards comprising cards surface mounted to an integrated carrier. Simplex and duplex variable data printing (VDP) may be used to apply trackable or non-trackable digital tags, stickers, labels, etc., outside of or within layers of plies used to create the trading cards (or other product). Digital tags, NFC (near field communications), and RFID (radio frequency identification) are nonlimiting examples of what may be used to link the products with electronic devices to expand a user's interaction and experience. Digital tags, stickers, and/or labels may be applied to a blank prior to or during processing to be conspicuous (external) or inconspicuously embedded within layers or plies that create the product, and to further enhance value-added and interactive user capabilities and create direct digital interactivity useful for direct mail, trading, collecting, promotions, coupon, etc. As known in the art, VDP may be monochrome or partial, single, or full color, and may be of any quality (including photo) that can be produced by available methods, including digital laser, inkjet, or other variable print methods. VDP may also be used to apply trackable or non-trackable barcodes, alphanumeric I.D. codes or sequences, addresses, data, etc.

Figure 5:
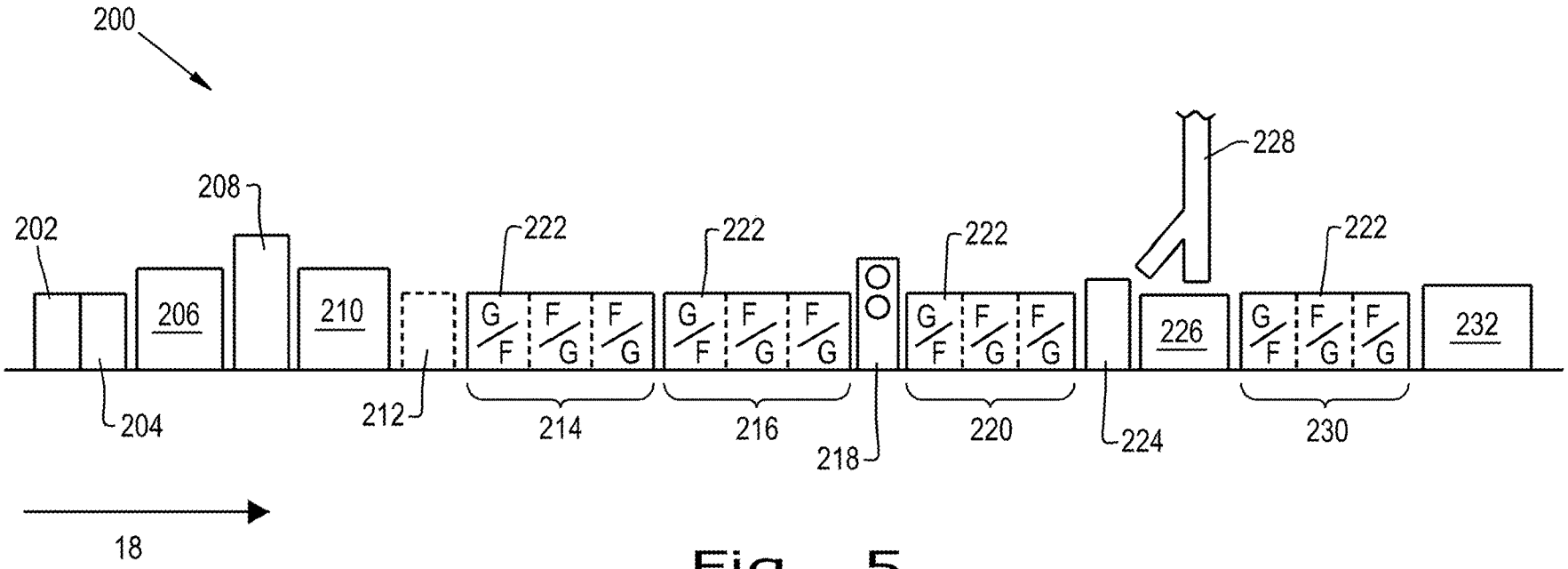
FIG. 5 represents a system and stations thereof that are suitable for performing the steps of FIGS. 6-10 in accordance with aspects of the present invention.

FIGS. 6-10 represent nonlimiting examples of promotional products and processing steps that may be employed to produce such products in accordance with aspects of the present invention, and FIG. 5 schematically represents a system 200 adapted for use in such processes. To facilitate the description of the manufacturing processes provided below, the terms "lateral," "front," "behind," "side," "lower," "higher," "about," "below," "right," "left," etc., may be used in reference to the perspective of the orientation of the system 200 represented in FIG. 5, and therefore are relative terms and should not be otherwise interpreted as limitations to the performance of the manufacturing processes or as limiting the scope of the invention. For convenience, consistent reference numbers are used throughout the drawings to identify the same or functionally equivalent elements.

Figure 2:
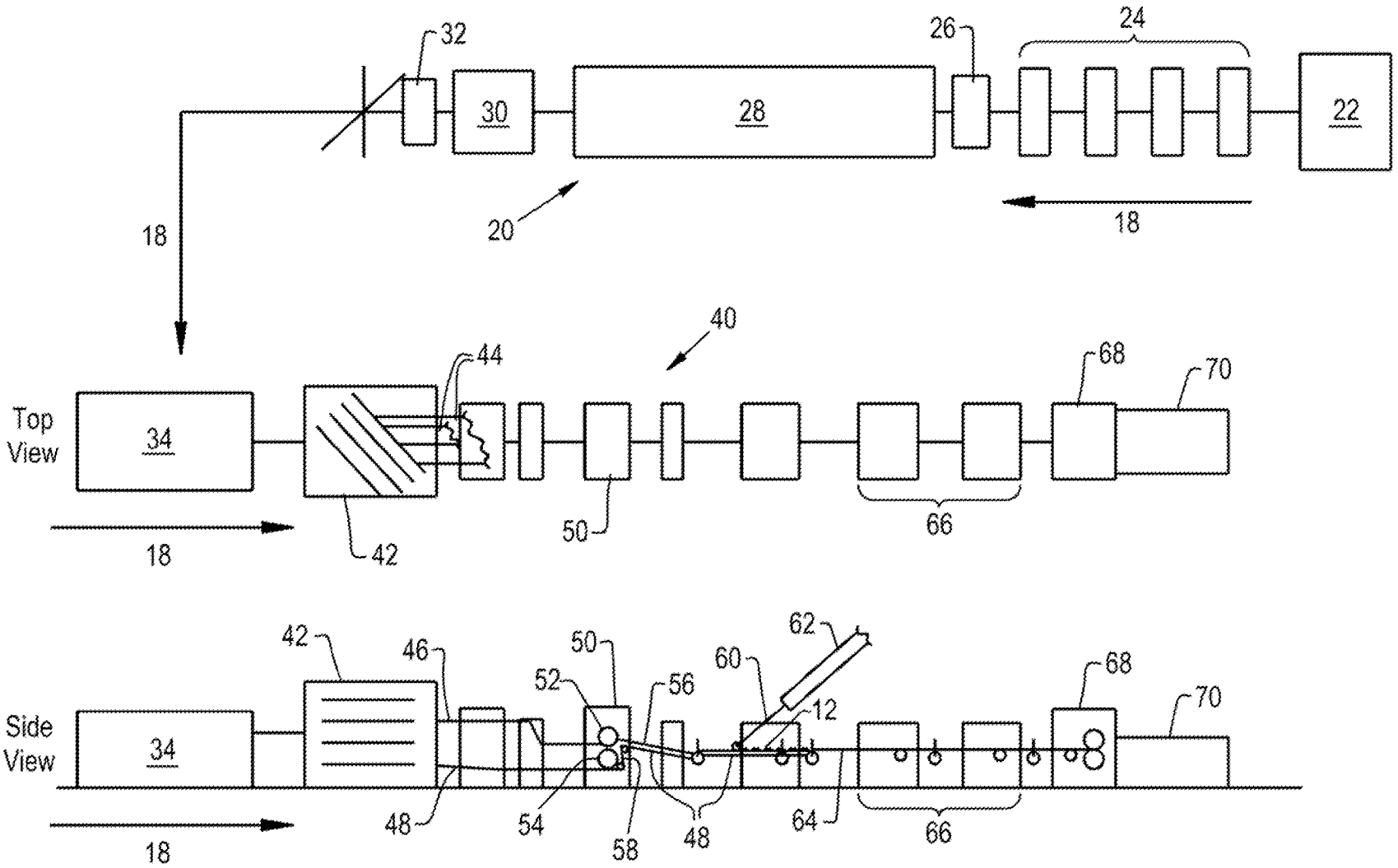
Prior Art Fig. 2
FIGS. 2-4 represent an exemplary web printing press and exemplary inline web finishing systems of types suitable for manufacturing the promotional products including those of FIGS. 1A-1F.
Figure 3:
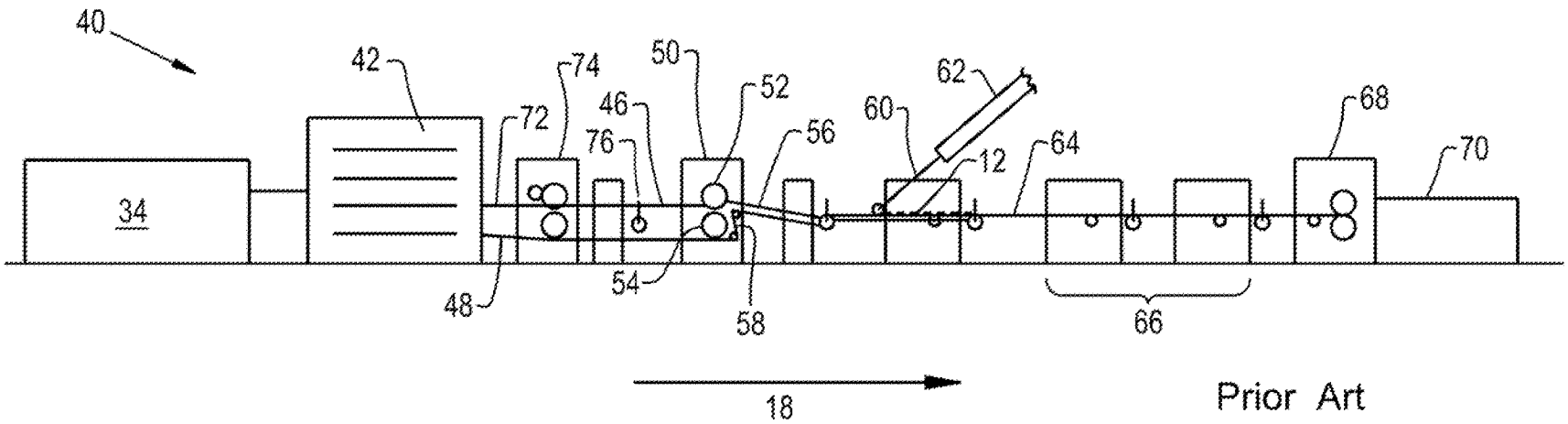
Prior Art Fig. 3
Figure 4:
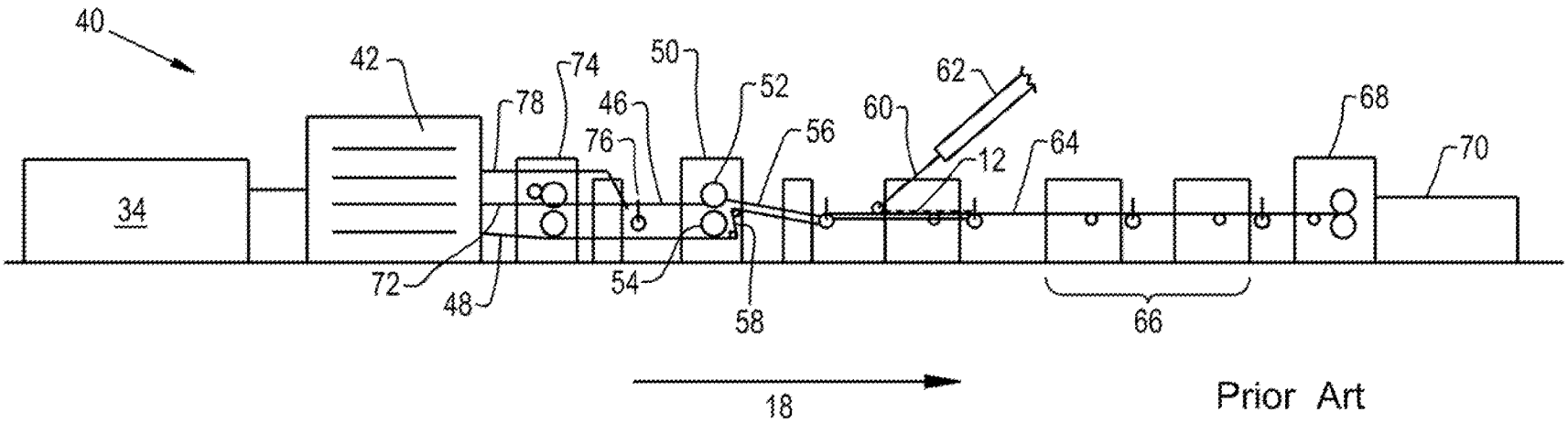
Prior Art Fig. 4

The system 200 represented in FIG. 5 is in part effectively adapted to replace the web finishing systems 40 of FIGS. 2 through 4. The system 200, which may be referred to as a folder/gluer line, is particularly configured for producing single- and multi-ply promotional products from single, individual, fully integrated (contiguous) preprinted or non-preprinted blanks (substrates) 100, nonlimiting examples of which are represented in FIGS. 6 and 8-10. As used herein and consistent with its general meaning in the printing industry, the term "blank" does not refer to the absence of printing or images, but instead refers to a cut-out or otherwise individual substrate ready for gluing and/or folding in a printing process. As such, "blank" refers to an individual article that is not processed by the system 200 as part of a continuous web and therefore, aside from trimming to a desired shape and size, does not require being die cut from a web after attachment of one or more cards thereto. The system 200 is represented in FIG. 5 as including a feeder station that may comprise a feeder unit 202 and an edge guide unit 204, followed by VDP stations 206 and 210 that apply individualized data to the blanks 100, a turnover unit 208, one or more optional "additions" stations 212, multiple folding stations 214, 216, 220, and 230 (each of which may include a gluing unit 222), one or more mid-line die cutters 218, a "slitting" station 224, a waste separation station 226 where waste separation occurs, a waste evacuation system 228, and a "postal-ready" station 232. In general, as represented the system 200 is configured to convey, VDP image, flip, on-sert, fold, glue, die cut, slit, and shingle/stack the blanks 100 in order to produce the final products, such as but not limited to the promotional (direct mail) products 10 of FIGS. 1A-1F, as well as a nonlimiting example of a promotional product 10 schematically represented in FIG. 7. For convenience, identical reference numerals are used in FIG. 7 to denote the same or functionally equivalent elements described for the products 10 of FIGS. 1A-1F, i.e., a card 12 mounted to a carrier 14.

As will become evident from the following discussion, the product 10 is representative of single-ply and multi-ply promotional products that can be produced by manufacturing process steps represented in FIGS. 6 and 8-10. While the system 200 is represented in FIG. 5 as comprising certain stations, units, etc., as noted above, it should be understood that the invention encompasses systems that could comprise fewer or additional stations, units, etc. Furthermore, there are many variations in how and in what sequence certain operations may be performed, and various hybrid executions are foreseeable. For example, VDP may be performed with a roll-fed (web) or sheet-fed press, and performed partially or entirely within one or more of the folding stations 214, 216, 220, and 230, etc. Similarly, blank and/or card creation may be performed with one or more die cutters located at the entry to one or more of the folding stations 214, 216, 220, and 230, at which point the blanks 100 may be individual sheets or portions of a web, for example, a sheet-fed printing press or a web printing press could directly feed a rotary die cutter to cut the blanks 100 immediately before feeding the blanks 100 directly into the first folding station 214, 216, 220, or 230.

Promotional products in accordance with aspects of the invention may be initially preprinted by applying images to a sheet or web using any printing means known or developed in the art, such as but not limited to a fixed repeat rotary sheet fed offset, web fed offset, digital, inkjet, flexographic, rotogravure or other type of printing press, as well as hybrids of any combination thereof. Printed sheets may have an approximate finished size of typically 1, 2, 3, 4 or 5 up/around, but can be any multiple of repeat images that fit into a rotary press repeat circumference. Preprinted sheets or a printed web may comprise completely variable images printed from a non-cylindrical inkjet, laser, or any other spray-on ink transfer printing method and specifically delivered sheeted as individual sheets into a receding pile, conveyor table, or other delivery. Printing may include one or both sides of a sheet or web and can include any ink color additions or sequence, UV cured coatings, aqueous coatings in any image pattern or area, or other application known in the art.

A particular but nonlimiting example of the above is to position the system (folder/gluer line) 200 immediately and directly following a printing press, which may utilize any print engine technology available and produce from sheet to sheet or roll to sheet a final cut preprinted blank 100 having any suitable format size for producing the intended card(s) 12 and carrier 14. The cutting operation that produces the blank 100 may take place at the exit of the press, or may take place at the entry of the system 200 or anywhere thereafter prior to a folding operation and therefore within a continuous "inline" blank conveyance and operation. As such, the system 200 is capable of being combined with a wide variety of printing presses and systems.

As a particular but nonlimiting alternative to the above, images can be applied to printed or non-preprinted blanks 100 after they have entered the system 200. Any suitable printing means can be employed to perform any portion or the entirety of the printing operation(s) performed to produce the product 10.

In particular embodiments, portions of a sheet or web that will later form the cards and carriers of the promotional products are preferably printed side-by-side and laterally across the width of the sheet or web, such that blanks formed therefrom, which in the nonlimiting examples illustrated in the drawings are represented by the aforementioned individual integral blanks 100 of FIGS. 6 and 8-10, may later be folded to produce the finished promotional products (such as the product 10 of FIG. 7). Preferably, VDP is performed prior to gluing and folding the blanks 100, but may be performed at any time with or during initial printing operations and/or after a blank 100 has been folded within the system 200. Other additions to the blanks 100 may be added at any time within the system 200 to enhance the value of the promotional product.

The blanks 100 may be sheet-printed onto sheets as completed 1up images requiring no further or additional cutting or trimming prior to introduction into the feeder unit 202 of the system 200. Alternatively, after printing the printed sheets or web may be cut to yield blanks 100, each being a desired individual final size, 1up, flat product having one or more flat panels. The blanks 100 may be cut from multi-up sheets or from a continuous web on any cutting machine known in the art, such as but not limited to, a standalone rotary, platen, or any other type of guillotine, reciprocal, rotary, or laser cutting machine, device, or die cutter. As a non-limiting example, the blanks 100 may be cut from a web using the rotary cutter-type machine 68 represented in FIGS. 2-4 prior to being fed into the feeder unit 202 of the system 200. Alternatively, the blanks 100 may be cut from printed sheets directly fed into the feeder unit 202, and subsequently into a rotary or platen die or any other type/method die cutter (not shown) positioned at the entry end of the system 200 as multiple up/around sheets. Bleed and gap trims may be performed to remove waste at the head and foot of each blank 100. Regardless of what type of system is used to produce and cut the blanks 100, the blanks 100 are preferably cut to their overall final shape and size prior to being placed on the entry conveyor (for example, prior to the feeder unit 202 depicted in FIG. 5) and prior to entering the VDP stations 206 and 210 and folding and gluing stations 214, 216, 220, and 230 of the system 200. The blanks 100 may be cut to an overall uniform rectangular shape, though optionally one or more panels of each blank 100 may be longer than other panels, creating what will be referred to as a waste extraction flap 108 (FIGS. 6A-6E, 8A-8B, 9A-9B, and 10A-10C), such that the blank 100 as a whole has an irregular rectangle shape. As will be discussed in reference to FIGS. 6A-6E, the process of defining a card 12 from a portion of the blank 100 (the portion being referred to herein as a card panel 112) results in waste material 110 that surrounds the card 12. Irregular cutting of the blanks 100 to include a waste extraction flap 108 is believed to significantly facilitate the extraction of the waste material 110 when using certain extraction equipment, for example, a cross-fold-drag-hook-and-lift unit 240 (hereinafter, hook and lift mechanism 240) schematically represented in FIG. 12. However, a waste extraction flap 108 may be unnecessary if another type of waste extraction technique is used, for example, a vacuum wheel 234 schematically represented in FIG. 11.

Figure 6A:
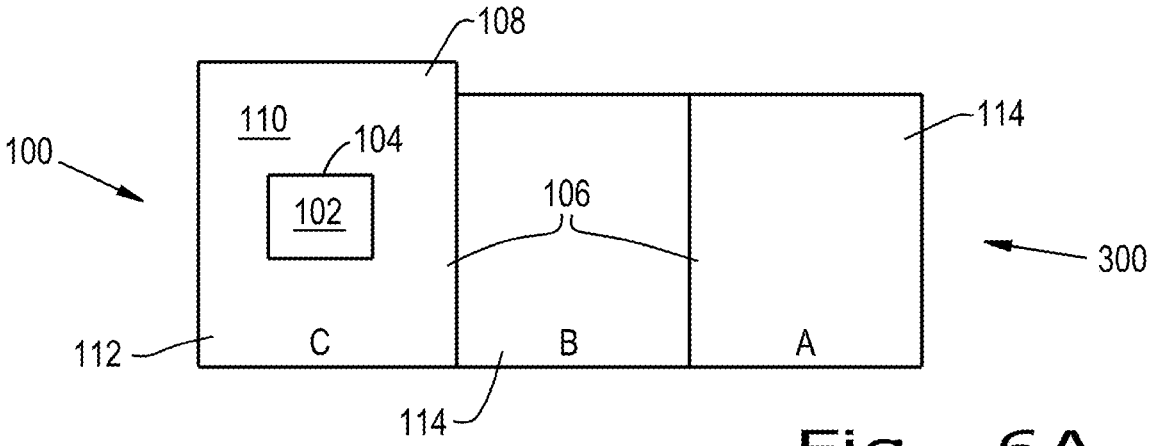
FIGS. 6A through 6F represent steps of a manufacturing process for producing a promotional product having a card attached thereto in accordance with a nonlimiting embodiment of the present invention.
Figure 6B:
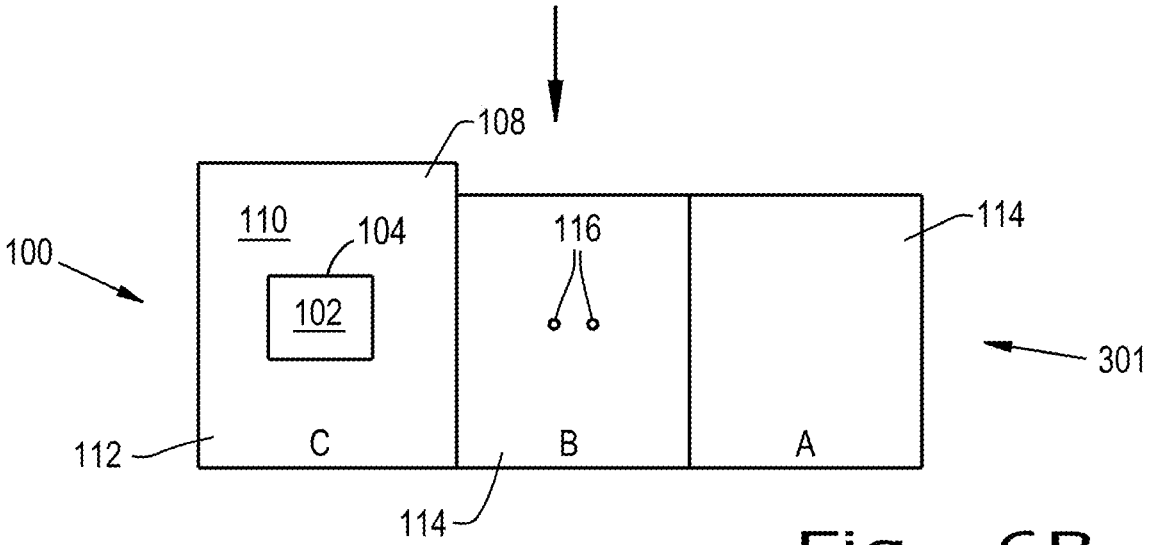
Figure 7:
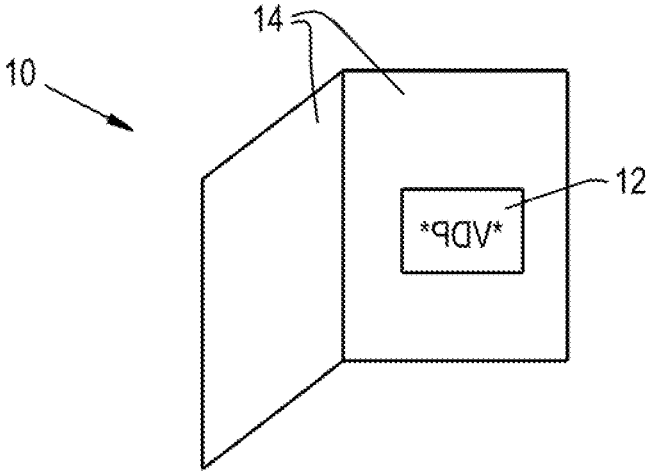
FIG. 7 represent a nonlimiting promotional product of a type that can be produced by the manufacturing process depicted in FIGS. 6A through 6F.
Figure 8A:
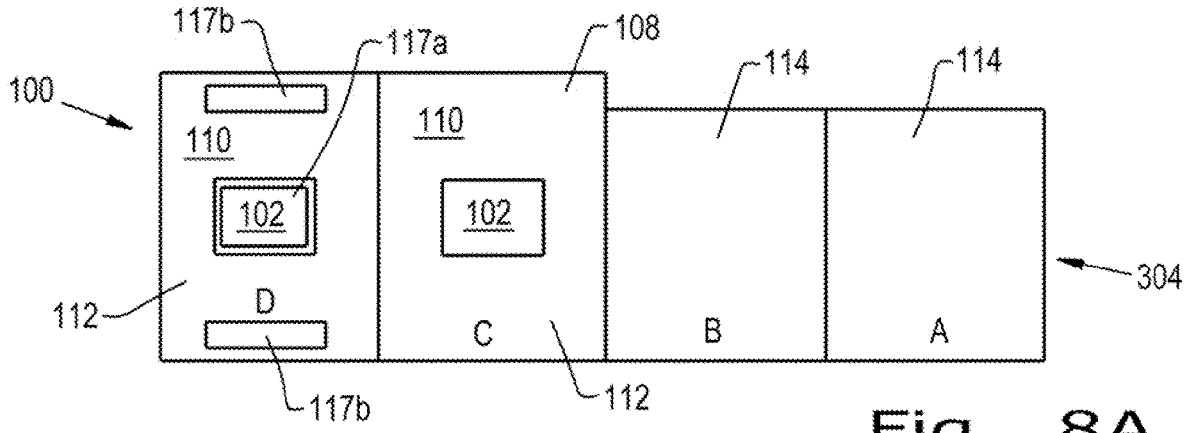
FIGS. 8, 9A-C, and 10A-B represent steps of alternative manufacturing processes for producing different types of promotional products having a card attached thereto in accordance with nonlimiting embodiments of the present invention.
Figure 9A:
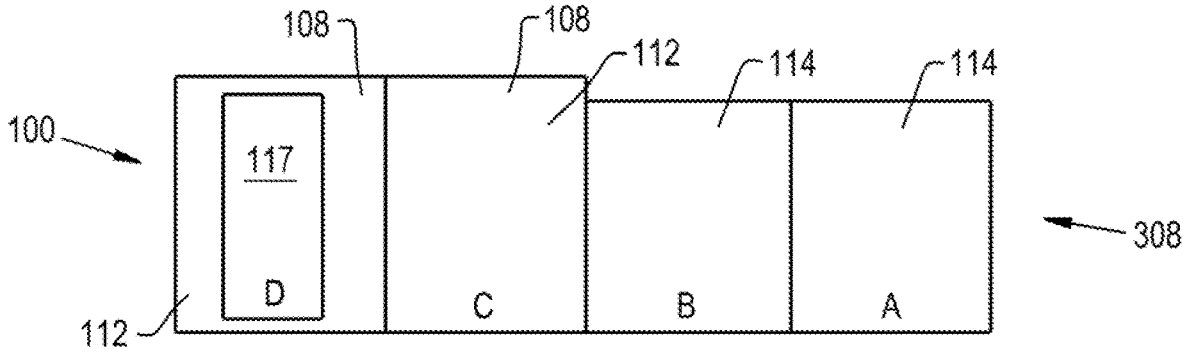
Figure 9B:
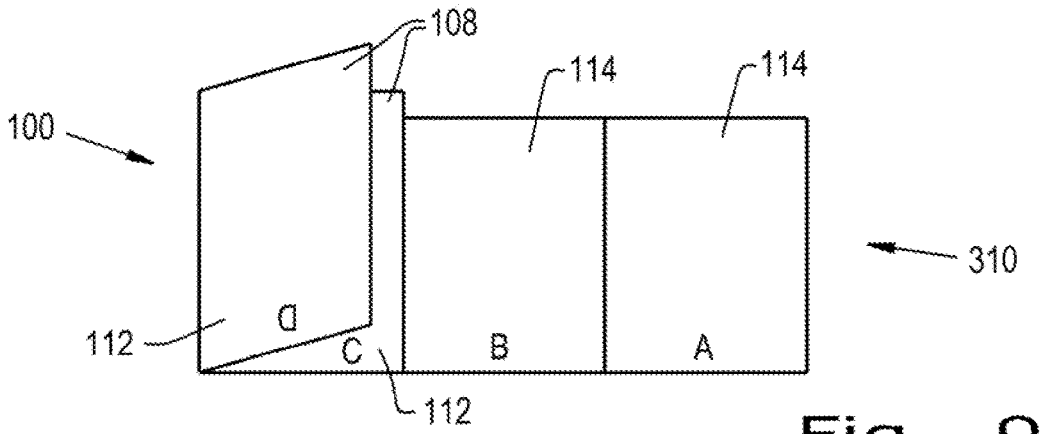
Figure 9C:
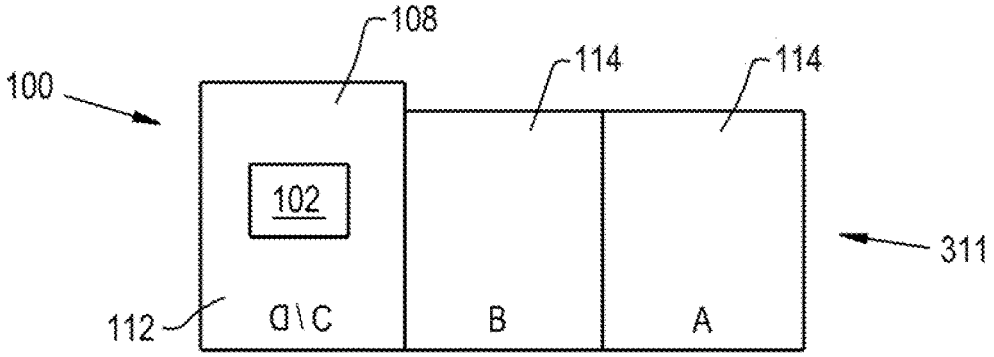

As will become evident from the following description, preparation of the blanks 100 on the system 200 can be limited to die cutting the cards 12 and/or single chop cuts or double cross cuts for bleed trim and/or gap removal, which may optionally include formation of the waste extraction flap 108, formation of the cards 12 with or without ties 104 to the carrier 14, and/or formation of folding scores along fold lines 106 (FIGS. 6A, 8A, and 9C). If such cutting processes are performed by the system 200, the bleed and gap trim waste formed by the crosscut is extracted immediately after the blank 100 leaves the die cutter (not shown). Once the blanks 100 have been formed, they are conveyed further into the system 200.

When utilizing blanks 100 with the waste extraction flap 108, the blanks 100 are preferably oriented and loaded into the feeder unit 202 with an orientation such that, regardless of a need later in the process to flop or turn over the blanks 100 for VDP, label application, on-serting, or any other additional processes, the waste extraction flap 108 will be at a first or leading edge of the blank 100 in the travel direction of the blanks 100 at a point within the system 200 (e.g. the waste separation station 226) where waste removal is performed to remove material 110 surrounding the cards 12 after the cards 12 have been secured to their carriers 14. As such, it will be apparent to those skilled in the art that consideration must be taken during format layout and printing to determine a correct orientation necessary for proper downstream gluing and plow folding of the blanks 100 so as to result in a desired finished product. In addition, consideration is preferably taken for any downstream processes needed to flop or turn over the blanks 100. As a nonlimiting example, if VDP is to occur on a back side of a portion of the blank 100 which will form a card 12, the blank 100 may be loaded into the feeder unit 202 of the system 200, bottom side up (inside of unfolded carrier panels), or facing upward. This orients the blanks 100 for proper VDP pagination, that is, applied in a downward direction towards to the desired imaged surface of the blanks 100 as opposed to performing VDP from below and therefore in opposition to gravity, though such an approach is also within the scope of the invention.

The blanks 100 may be fed into the system 200 by any means known in the art, nonlimiting examples of which include driven by a gravity, friction, or suction vacuum feeder wheel (not shown) associated with the feeder unit 202, which delivers the blanks 100 to an entry conveyor (not shown) and edge guide unit 204. The blanks 100 can be conveyed through the system 200 at speeds typical to the art, for example, with laterally positioned upper and lower motor driven tapes, belts, and/or rollers along the entire length of the system 200 that convey the individual blanks 100 through the various processing stations and units of the system 200. These driving methods are well known in the art and therefore will not be explained further herein.

According to a preferred aspect of the invention, promotional products processed by the system 200 may include personalized data applied by simplex and duplex VDP, schematically represented by the two VDP stations 206 and 210 in FIG. 5. Although VDP of trackable or non-trackable data and any other "value added" product format additions may be applied during printing of the sheets or webs from which the blanks 100 are formed, and therefor prior to the blanks 100 entering the system 200, such additions may be performed by the system 200, and in particular prior to the folding stations 214, 216, 220, and 230 of the system 200. This however may add a level of complexity to the process by requiring accurate and intensive "cut and stack" procedures during rotary or platen or any other type/method die cutting of the blanks 100 in order to maintain postal sort sequence throughout the entire finishing process. There may also be additional secondary processes after printing, for example, the addition of foils, mechanical embossing, labels, on-serting, information tracking means such as RFID tags/labels, NFC tags/labels, and/or other information tracking "microchips", etc. Any of the above additions may also be applied after the sheets or web are converted into blanks 100.

In the example of FIG. 5, personalized data may be applied by the VDP station 206 and the ink applied thereby is preferably immediately dried using any drying process known in the art, such as but not limited to infrared (IR) drying. Thereafter, the blank 100 may be turned over with the turnover unit 208, which may employ any turnover or flopping means known in the art, such as but not limited to a buckle fold/head stop attachment modified, designed or otherwise adapted to flop or turn over the blanks 100. Turning of the blanks 100 may be accomplished with head to foot, left to right, or right to left methods, as long as the method results in the blank 100 being turned over from top side up to bottom side up in the process. As evident from FIG. 5, turning of the blanks 100 allows for VDP on two sides of the blanks 100 with the VDP station 210. Turning of the blanks 100 may also be used to appropriately orient the blanks 100 for the subsequent folding stations 214, 216, 220, and 230 of the system 200. In addition, turning may be desirable or necessary for other process application equipment employed in the system 200, for example, label applicators, on-serting, information tracking means such as RFID or NFC labels/tags, etc., which may be applied to either side of the blanks 100. Such value-added product format additions may be applied at the optional additions station 212 represented in FIG. 5.

Once all printing, VDP, and application of additions is complete, the blanks 100 undergo folding, gluing, and cutting processes to produce the final promotional product 10. According to a preferred aspect of the invention, once the blank 100 has been created, a card 12 that is to be applied to the carrier 14 of its promotional product 10 is created from but not initially removed from one or more "card" panels of the blank 100, such that processing of the blank 100 initially results in what will be referred to as a partially cut-out card 102 in the blank 100. Each card panel 112 may be perforated such that its partially cut-out card 102 remains secured to its blank 100 with the aforementioned ties 104 to prevent the partially cut-out cards 102 from falling out of the blank 100 during subsequent folding and gluing processes. However, it is also within the scope of the invention that a partially cut-out card 102 could be partially or solely retained by friction, edge contact, static electricity, etc., without the use of ties 104, and therefore as used herein the term "partially cut-out card(s)" encompasses such possibilities. The blanks 100 are glued and folded in a manner so as to apply the partially cut-out cards 102 in the card panels 112 of the blanks 100 to "carrier" panels of the blanks 100 intended to form the carrier 14 of the promotional product 10. As represented in FIG. 8A, if a card 12 is intended to be multi-ply, the partially cut-out cards 102 may be formed in multiple adjacent card panels 112 and positioned across and opposite from one another so that after gluing and folding of the card panels 112, the partially cut-out cards 102 are aligned (superimposed) and can be glued together to form a single, multi-ply card 12. Alternatively, as represented in FIG. 9C, a multi-ply card 12 can be produced by simultaneously forming partially cut-out cards 102 in multiple card panels 112 after gluing and folding the card panels 112, such that the individual partially cut-out cards 102 are aligned as a result of the cutting operation. Notably, the cards 12 may be cut to have any shape or size, and may be cut to be partially attached to or completely detached from any number of single- or multi-ply bonded material plies formed of any woven or non-woven paper or other material.

FIGS. 6A-6F are representative of a process for producing a single-ply card 12 applied to a carrier 14. In FIG. 6A, the blank 100 is represented at step 300 as initially including a single card panel 112 "C" and two carrier panels 114 "A" and "B." The carrier panel B is contiguous with each of the carrier panel A and the card panel C, with corresponding fold lines 106 defined therebetween. Card panel C includes the aforementioned optional waste extraction flap 108 and has been previously die cut to have a partially cut-out card 102. The die cutting operation that forms the partially cut-out card 102 can be performed at any time prior to the condition of the blank 100 represented in FIG. 6B, which shows glue spots 116 as having been applied (for example, by the gluing unit 222 of the first folding station 214) to the carrier panel B contiguous with the card panel C. The glue spots 116 are applied at locations that will be contacted by the partially cut-out card 102 after the card panel C has been folded over and onto carrier panel B along a fold line 106 therebetween, as represented by step 302 of FIG. 6C (for example, performed at the first folding station 214), such that the partially cut-out card 102 contacts the glue spots 116 and is secured therewith to carrier panel B. The remainder of the card panel C surrounding the partially cut-out card 102 does not contact the glue spots 116 and therefore is not attached to the carrier panel B, and as such is capable of being extracted as waste material 110.

Figure 6C:
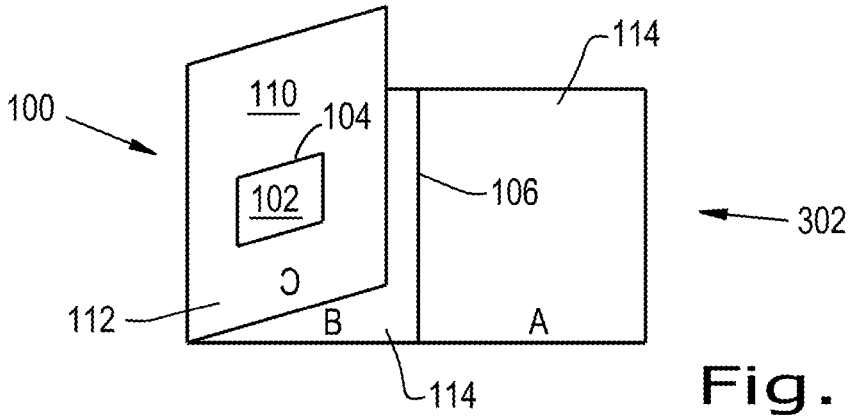
Figure 6D:
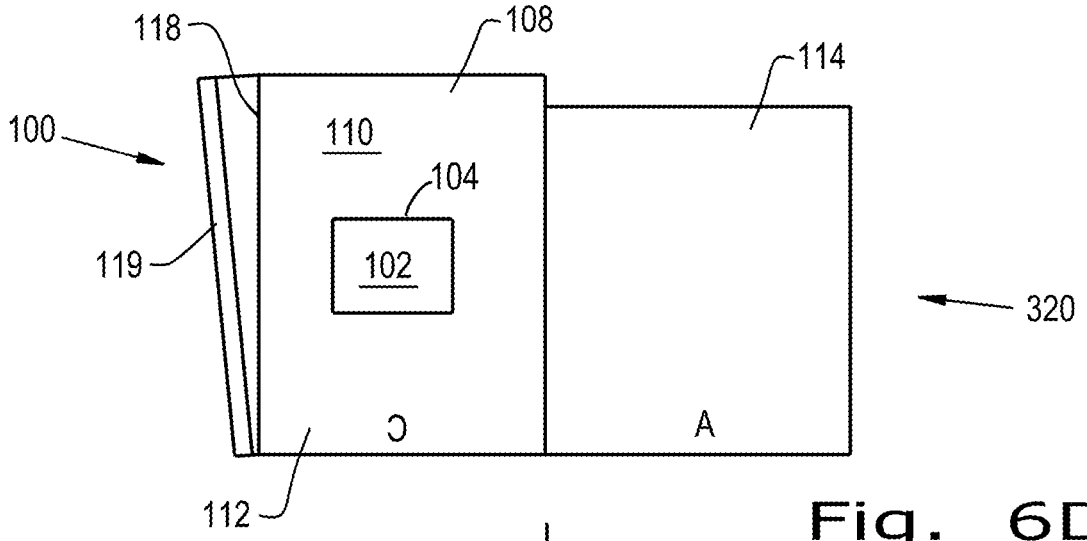
Figure 6E:
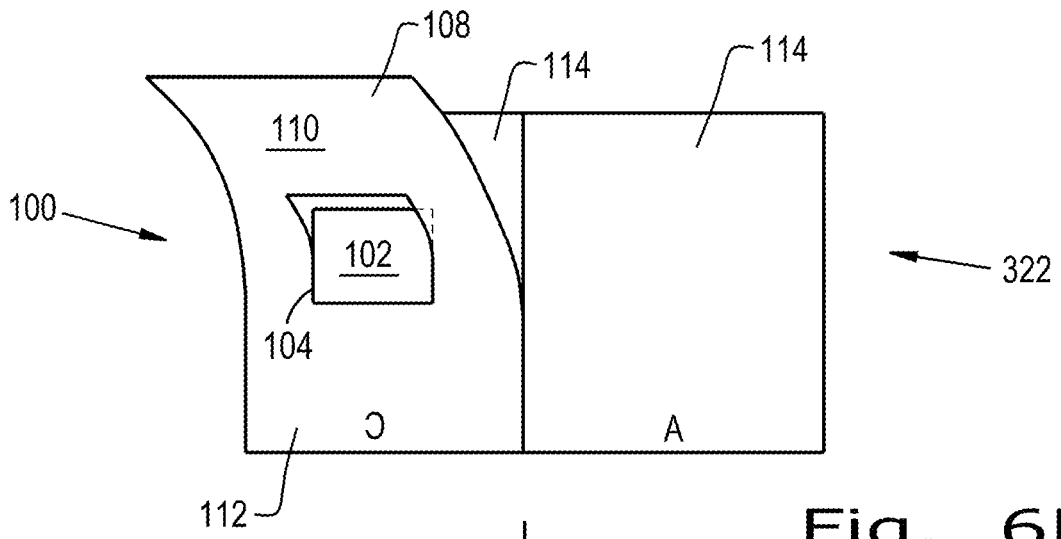
Figure 6F:
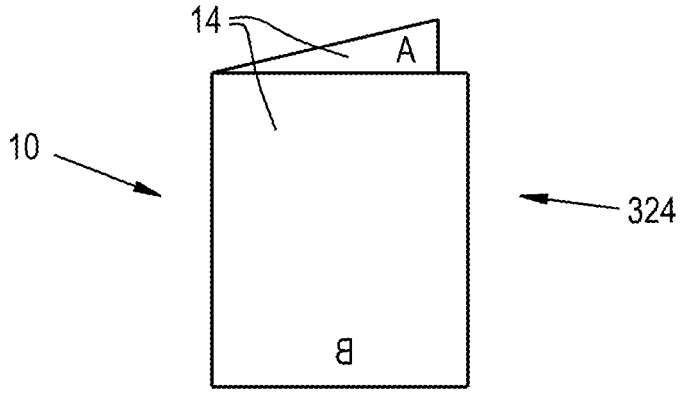

FIGS. 6D through 6F represent further steps performed on the blank 100 produced by step 302 of FIG. 6C. As will become apparent from the discussions of FIGS. 8A-B, 9A-C, and 10A-B, the steps represented in FIGS. 6D-6F can be common to the card finishing sequences described in FIGS. 8A-B, 9A-C, and 10A-B, and therefore can be employed regardless of whether the product 10 is single-ply or multi-ply or the manner in which cards 12 are die cut from the blanks 100. The folding operation of FIG. 6C has created an outer folded edge, referred to as a backbone or spine 119, formed by the combined folded panels B and C. The spine 119 can be removed by slitting the spine 119 (for example, at the slitting station 224 of FIG. 5), as represented in step 320 of FIG. 6D, resulting in a defined edge 118 of the blank 100. In addition, because the remainder of the card panel C surrounding the partially cut-out card 102 was not attached to the carrier panel B, this remainder is detached as a result of the slitting operation and the waste extraction flap 108 can be used in step 322 to remove this remainder from the blank 100 as a waste material 110. Removal of the waste material 110 can be performed at the waste separation station 226 by the waste evacuation system 228 of FIG. 5, for example, as discussed in reference to FIGS. 11 and 12, such that all portions of the card panel C are removed other than the partially cut-out card 102 attached to the carrier panel B. As the waste material 110 of the card panel C is removed, any ties 104 securing the partially cut out card 102 will tear, such that only the resulting card 12 is attached with the glue spots 116 to the carrier panel B. In step 324, a fold line 106 (FIG. 6A) between the carrier panels A and B is folded (for example, at the folding station 230), such that the blank 100 becomes a final promotional product 10 having the single-ply card 12 enclosed between portions of the carrier 14 defined by the carrier panels A and B. FIG. 7 depicts the product 10 oriented and partially unfolded to reveal the card 12 attached to the carrier 14.

Figure 8B:
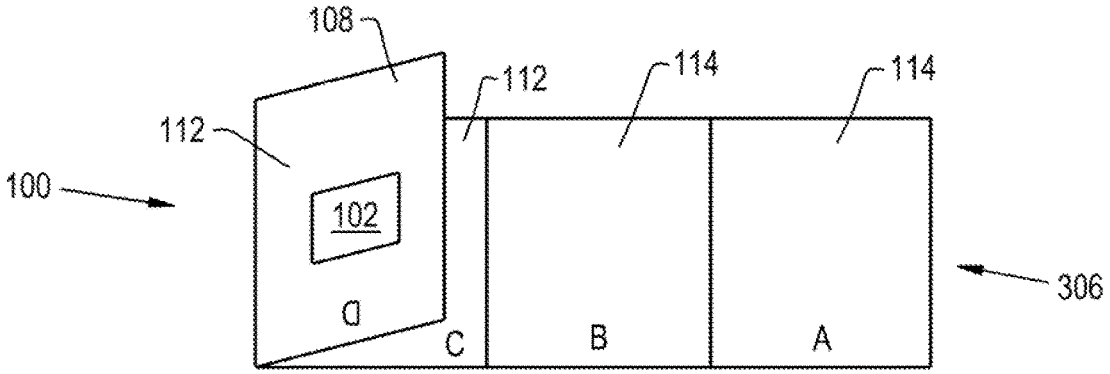

FIGS. 8A and 8B represents steps of a nonlimiting example by which a double-ply card 12 can be formed and attached to a carrier 14. As a matter of convenience, the blank is identified in FIGS. 8A and 8B with the reference number 100, though the blank has a physical configuration that is different from the blank 100 of FIG. 6A. In step 304, the blank 100 includes two carrier panels 114 "A" and "B," and two card panels 112 "C" and "D." The carrier panel B is contiguous with each of the carrier panel A and the card panel C with corresponding fold lines 106 defined therebetween, and the card panel C is further contiguous with the card panel D with a corresponding fold line 106 therebetween. Each of the card panels C and D includes a waste extraction flap 108 and has been previously die-cut to have a partially cut-out card 102 surrounded by a waste material 110. FIG. 8A shows a glue pattern 117*a* that has been applied to the partially cut-out card 102 of the card panel D, which is the card panel 112 located farthest from the carrier panels 114. Glue 117*b* has also been applied to the waste material 110 of the panel D, avoiding the die-cut surrounding its partially cut-out card 102. At step 306, the card panel D is folded over and onto the card panel C (for example, at one of the folding stations 214 or 216) so that their partially cut-out cards 102 are aligned (superimposed) and glued together with the glue pattern 117*a* to eventually form a single, multi-ply card 12 (equivalent to the card 12 in FIG. 7). At this point in the process, the configuration of the blank 100 resulting from step 306 is generally equivalent to the blank 100 in step 300 of FIG. 6A, in that the combined card panels C and D of step 306 is generally equivalent to the single card panel C of step 300, other than being double-ply instead of single-ply. As such, subsequent processing steps may commence with step 301 of FIG. 6B, starting with application of the glue spots 116, and continue to produce a final promotional product 10 having the double-ply card 12 enclosed between carrier panels A and B. Notably, because the waste material 110 of the card panels C and D are bonded to each other with the glue 117*b* as a result of the folding step 306, the waste material 110 can be simultaneously removed (step 322) following removal of the spine 119 (step 320) formed by panels B, C, and D, such that all portions of the card panels C and D are removed other than the bonded partially cut-out cards 102. As the waste materials 110 are removed, any ties 104 securing the partially cut-out cards 102 will tear, leaving the double-ply card 12 on the carrier panel B. Following step 324 (FIG. 6F), the resulting product will again have the overall appearance of the product 10 depicted in FIG. 7.

The order and number of such card cutting, folding, and gluing processes will be dependent on the desired final product. In the embodiments of FIGS. 6A-6F and 8A-8B, die cuts to form the partially cut-out cards 102 are performed prior to folding, and can be performed prior to the blank 100 entering the system 200 of FIG. 5 or as one of the initial process steps performed within the system 200. Alternatively, as represented by the embodiments of FIGS. 9A-9C and 10A-10B, the partially cut-out cards 102 may be formed in the system 200 following a gluing and folding operation, for example, with the use of one or more mid-line die cutters 218, and then followed by one or more additional folding and/or gluing steps.

FIGS. 9A-9C represent a nonlimiting example of a process for producing a double-ply card 12 similar to that produced by the process of FIGS. 8A-8C, modified to form the partially cut-out cards 102 after a gluing step. In FIG. 9A, the blank 100 initially includes two carrier panels 114 "A" and "B" and two card panels 112 "C" and "D." In contrast to FIG. 8A, which depicts a similar four-panel blank 100, the partially cut-out cards 102 have not been pre-die cut in the card panels C and D during the formation of the blank 100. In step 308, a nonlimiting glue pattern 117 is applied to the card panel D to the extent necessary to bond the portion(s) of the card panels C and D in which a partially cut-out card 102 is to be formed. In step 310, card panel D (again, the card panel 112 located farthest from the carrier panels 114) is folded over and onto the card panel C (for example, at one of the folding stations 214 or 216) such that the panels C and D contact and are secured to one another by the glue pattern 117. In step 311, the partially cut-out card 102 is formed (for example, with the use of one or more mid-line die cutters 218) by die-cutting the combined panels C and D, such that the partially cut-out card 102 is double-ply and simultaneously formed in the panels C and D. At this point in the process, the blank 100 produced by step 311 is generally equivalent to the blank 100 resulting from step 300 of FIG. 6A, in that the combined panels C and D of step 311 are generally equivalent to the panel C seen in FIG. 6A except for being double-ply instead of single-ply. As such, subsequent processing steps may commence with step 301 of FIG. 6B, starting with application of the glue spots 116, and continue to produce a final promotional product 10 having the double-ply card 12 enclosed between carrier panels A and B. As with the embodiment of FIGS. 8A-8A, because the waste materials 110 of the card panels C and D are bonded to each other as a result of the folding step 310, the waste materials 110 can be simultaneously removed (step 322 of FIG. 6E) following removal of the spine 119 (step 320 of FIG. 6D) formed by the panels B, C, and D, such that all portions of the card panels C and D are removed other than the double-ply partially cut-out card 102. As the waste materials 110 are removed, any ties 104 securing the partially cut-out card 102 will tear, leaving the double-ply card 12 on the carrier panel B. Following step 324 (FIG. 6F), the resulting product will again have the overall appearance of the product 10 depicted in FIG. 7.

Figure 10A:
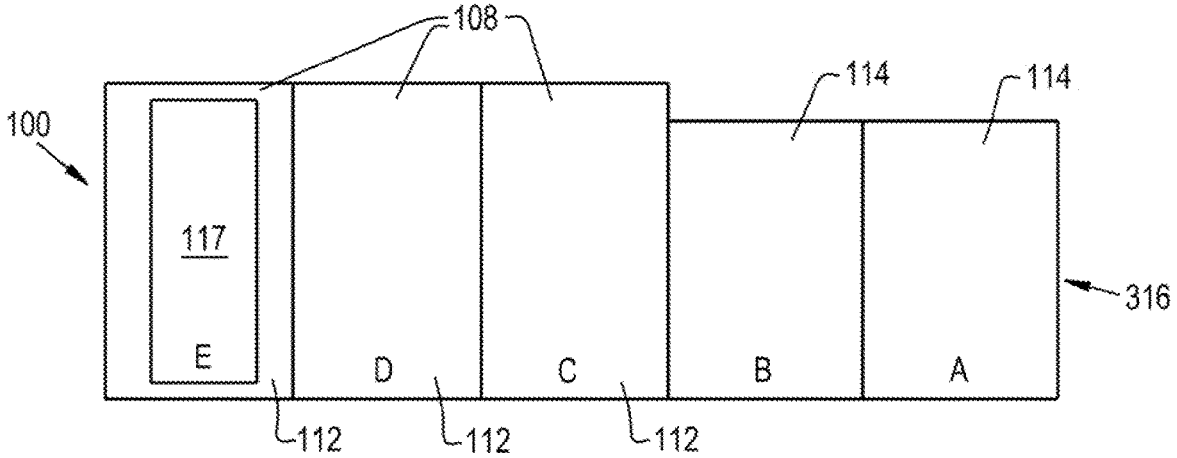
Figure 10B:
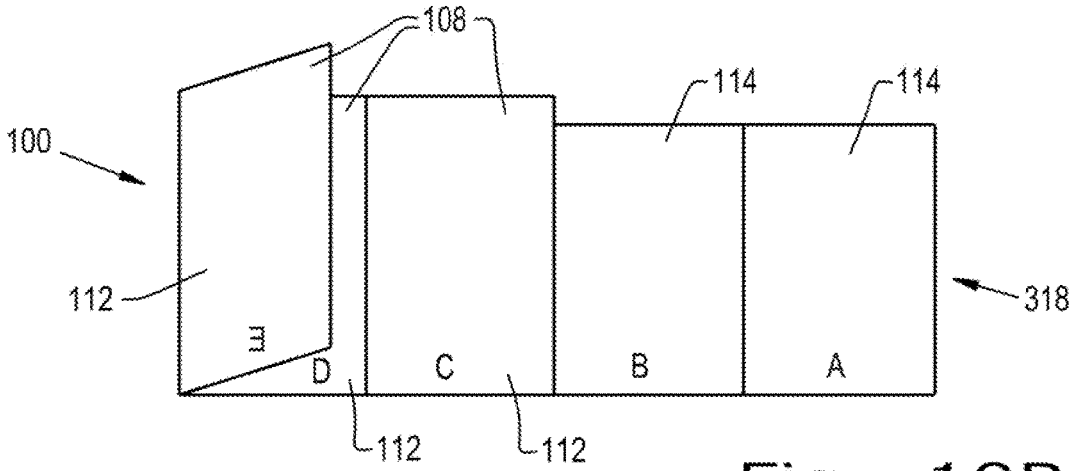

The cards 12 and carriers 14 may be produced to have more plies by simply adding additional panels to the blank 100 and then gluing and folding the panels to increase the final thickness of the card 12 and/or carrier 14. Folding stations may be added prior to the slitting station 224 to more easily process multi-ply promotional products of three plies or more. As a nonlimiting example, FIGS. 10A and 10B represent steps in a process for producing a promotional product 10 having a triple-ply card 12. As represented, the blank 100 initially includes two carrier panels 114 "A" and "B," and three card panels 112 "C," "D," and "E." As with the blank 100 of FIG. 9A, the carrier panel B is contiguous with each of the carrier panel A and the card panel C with corresponding fold lines 106 defined therebetween, and the card panel C is further contiguous with the card panel D with a corresponding fold line 106 therebetween. Additionally, the card panel D is also contiguous with the card panel E with a corresponding fold line 106 therebetween. In step 316, a glue pattern 117 is applied to the card panel E to the extent necessary to bond the portion(s) of the card panels D and E in which two aligned partially cut-out cards 102 are to be formed. In step 318, the card panel E (again, the card panel 112 located farthest from the carrier panels 114) is folded over and onto the card panel D (for example, at one of the folding stations 214 or 216) such that the panels D and E contact and are secured to one another by the glue pattern 117. At this point in the process, except for the absence of the glue pattern 117 the blank 100 produced by step 318 is generally equivalent to the blank 100 shown in FIG. 9A, in that the combined panels D and E of step 318 is generally equivalent to the panel D seen in FIG. 9A except for being double-ply instead of single-ply. As such, subsequent processing steps may commence with step 308 of FIG. 9A, starting with application of the glue pattern 117 to the combined panels D and E, and continuing through steps 310 and 311 of FIGS. 9B and 9C and then continuing further on through the steps represented in FIGS. 6B through 6F to produce a final promotional product 10 having a triple-ply card 12 (formed by the card panels C, D and E) enclosed between the carrier panels A and B. The type of glue and fold sequence performed to bond the combined panels D and E with the third card panel C is commonly referred to a "roll fold" sequence with a unique function being that each panel is fully or partially glued together to create multiple plies. As with the prior embodiments of FIGS. 8A-8AB and 9A-9C, because the waste materials 110 of the card panels C, D and E are bonded to each other as a result of the folding steps 318 and 310, the waste materials 110 are bonded to each other and therefore can be simultaneously removed (step 322 of FIG. 6E) following removal of the spine 119 (step 320 of FIG. 6D) formed by the panels B, C, D, and E, such that all portions of the card panels C, D and E are removed other than the triple-ply partially cut-out card 102. As the waste materials 110 are removed, any ties 104 securing the partially cut-out card 102 will tear, leaving the triple-ply card 12 on the carrier panel B. Following step 324 (FIG. 6F), the resulting product will again have the overall appearance of the product 10 depicted in FIG. 7.

In view of the foregoing, single and multi-ply partially cut-out cards 102 can be formed in the blanks 100 prior to entering the system 200 (FIGS. 6A and 8A) by die cutting the blanks 100 or an entire multi-up press sheet or web from which the blanks 100 are made to produce single and multi-ply cards 12, whereas multi-ply partially cut-out cards 102 formed in the blanks 100 within the system 200 (FIG. 9C) may be die cut with the use of one or more mid-line die cutters 218 to produce multi-ply cards 12. The mid-line die cutter(s) 218 may be used to die cut single-ply partially cut-out cards 102 while the panels of the blanks 100 are flat, or die cut multi-ply partially cut-out cards 102 after gluing and folding panels of the blanks 100 together into multi-ply thicknesses.

The mid-line die cutter 218 may be any type of die cutter known in the art, such as but not limited to rotary and platen die cutters, or laser, or any other type/method capable of making a complete cut or kiss-cut, the latter referring to a technique in which the die cutter cuts to a specific depth through a substrate (e.g., one or more card panels 112) while leaving an underlying substrate (e.g., carrier panel 114) uncut. The mid-line die cutter 218 may have several locations within the system 200 and include special modifications such as a sidelay adjustable die-cutting cylinder head and specialty transport sections designed to convey under control individual blanks 100 through the rotary cylinder sections. The mid-line die cutter(s) 218 in the form of a rotary-style die cutter may be specifically designed with any circumference to match any product length with repeat, or non-repeat matching mid-line die cutter designs may employ a motor drive system that operates independently of the main drive of the system 200 and may further utilize an "electronic cam profile" cutting cylinder drive or other nonlimiting electronic and/or mechanical technology. As a nonlimiting example, changeable die cutting cassettes, cylinders or sleeve style designs can be employed to allow changes in the circumferential size of a rotary-style die cutter to meet the conveyance of the blanks 100 by promoting the timing and positional accuracy of the blanks with respect to desired die cut locations on the blanks 100. It is foreseeable that other control and registration techniques could be used to synchronize the die cutter(s) 218 with the blanks 100 as the blanks 100 pass through the die cutter(s) 218 during die cutting of the card(s) 12 or the partially cut-out cards 102 from which they are formed. In the case of a rotary-style die cutter, an independent motor drive system may include separated drive motors for a die cutting cylinder and opposing anvil cylinder, and/or for a conveyance drive carrying the blanks 100 through the die cutter 218. Other types of die cutters commonly used in rotary die cutters include commercially available flexible magnetic die using a magnetic mount die cylinder or a solid type die screw lockdown style made normally of steel or composite materials. Mid-line die cutters 218 for use in the system 200 may also be used in multiples to separate x and y axis cutting, and/or portable and moveable to allow the cards 12 to be die cut to any shape or thickness.

According to an aspect of the invention, the mid-line die cutter 218 forms the partially cut-out cards 102 immediately prior to the gluing and folding operation by which a partially cut-out card 102 formed by one or more card panels 112 is semi-permanent fixed to the one of the carrier panels 114 prior to removal of the waste material(s) 110. As apparent from the forgoing discussion of FIGS. 6A-6F, FIGS. 8A-8B, 9A-9C, and 10A-10C, such a process may involve any number of card panel gluing and folding processes prior to the die cutting operation, and the die cutting operation may be made through any number of previously folded card panels 112 (plies).

According to another aspect of the invention, the partially cut-out cards 102 may be formed by the mid-line die cutter 218 after all folding and gluing operations have been performed on the panels 112 and 114 of the blank 100. In such situations, all card panels 112 to be glued and folded, including the final fold onto the spot glues 116 of the card panel 112 or panels 112 bearing what will be the partially cut-out cards 102, occurs before any die cutting operation takes place. The cards 12 are only thereafter die cut from the card panels 112 using the mid-line die cutter 218 set to a specific depth and pressure adjustment to cut through only the card panels 112 while leaving the underlying carrier panel 114 uncut. Such a kiss-cutting technique eliminates the need to perforate die cut the card panels 112 immediately prior to the final fold-over of the card panels 112 at the score line 106 onto glue spots 116, and instead the cards 12 are completely separated from the card panels 112 with a single cut after all folding and gluing operations have taken place.

The use of scores or another technique, such as cut scores or perforations formed by channel, crush, or other methods, is believed to be advantageous to the folding processes within the system 200. When single-ply cards are produced (e.g., FIGS. 6A-6F), high accuracy matching of folding panels may not be required and therefore scoring may not be necessary. When multi-ply cards are produced (e.g., FIG. 8A-8B, 9A-9C, or 10A-10B), folding accuracy is critical to ensure that the partially cut-out cards 102 and/or card panels 112 are located in the desired lateral position, especially when multiple partially cut-out cards 102 are to be combined to form a multi-ply card 12 (e.g., FIGS. 8A-8B). In such situations, initial die placement and scoring position accuracy along fold lines 106 directly between the card panels 112 may be of utmost importance. Notably, if the blanks 100 were not previously scored during the blank formation process, it is entirely possible and viable to score the blanks 100 with an appropriate scoring unit included in the system 200 using any process known in the art. As such, scores may be formed within fold lines 106 on an entire multi up press sheet, web, or blank 100 at any time or any place while the sheet, web, or blank 100 is flat and yet to be glued and/or folded. Although not required for single-ply card formats, scoring or perforation is typically preferred to provide overall general product quality when folding heavy gauge paper stock.

Folding operations performed by any one or more of the folding stations 214, 216, 220, and 230 of the system 200 are preferably performed with a plow fold blade designed "down" and the folding panel being folded upward and over. However, the system 200 can be configured for "up" fold orientations, i.e., opposite the prior description, loading and format procedures remain the same and may eliminate blank flopping or turn over. Regardless, methods of production for both "up" and "down" fold orientation are within the scope of aspects of the present invention.

Single- and multi-ply cards 12 of promotional products 10 produced with the system 200 will typically be glued to one of the carrier panels 114 during the final folding operation (e.g., at folding station 230) with one or more spots 116 or other suitable pattern of a hot melt glue using any gluing system known in the art, such as but not limited to a rotary, mechanical, pattern programmable electronic slot head, extrusion, spray, or other for hot melt or cold glue station. While shown in FIG. 6B as applied to one of the carrier panels 114, the glue spots 116 may be applied to the side of the partially cut-out card 102 facing the carrier panel 114. The glue spots 116 are preferably sequenced and timed to be precisely applied to the carrier panel 114 in one or more locations so that the partially cut-out card 102 will contact the glue spots 116 upon the final folding operation. In accordance with certain aspects of the invention, timing of the cards 12 and the carriers 14 always remains constant and never out of time (as possible with conventional printing, card placement, and finishing techniques) due to the inherent nature of plow folding of the card panels 112 over onto the carrier panels 114 with an intact backbone or spine (at the fold line 106 therebetween) remaining in place during folding. This process, along with the use of identical and contiguous paper stock blank for cards and carriers, also ensures both circumferential and lateral registration of fine graphics content, color match, and "crossover image" match between the cards 12 and the carriers 14.

As described previously, after completion of the final folding of the card panel 112, waste materials 110 remain connected to the remainder of the blank 100 with previously folded backbones or spines 119, which physically connect the card panels 112 to the carrier panels 114, and, if present, the ties 104 between the waste materials 110 and the partially cut-out cards 102 that were previously glued to the carrier panels 114. As represented in FIG. 6D, such a spine 119 created from folded card panels 112 is located at an outer edge of the blank 100, and may be removed by using the slitting section 224 to cut the spine 119 from the remainder of the card panels 112. The slitting section 224 may be, but is not limited to, a crush-type rotary slitter wheel which crush/pressure slits against a rotary lower hardened anvil roll surface, or a shear-type rotary slitter which face slits against a side or lower rotating hardened anvil cylinder. Once the spine 119 has been cut, the waste evacuation system 228 may be used to remove the waste materials comprising the spine 119.

Figure 12:
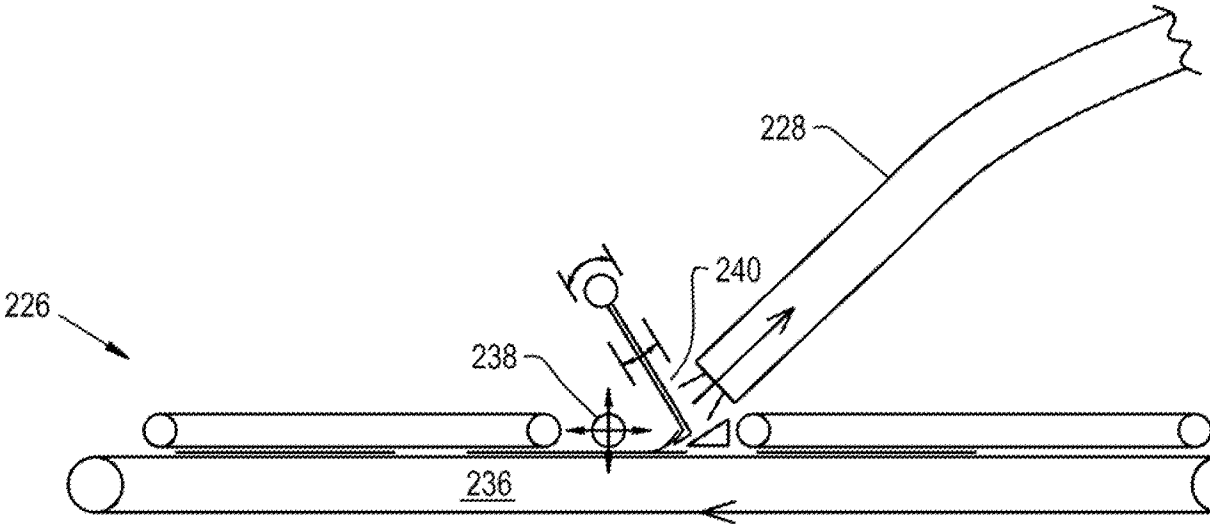

As previously noted, the optional waste extraction flap 108 provides an additional region of material (e.g., paper) at what becomes the leading edge of the blank 100 as it reaches the waste separation station 226 in the system 200. Because the waste extraction flap 108 extends or protrudes beyond the desired finished length of the promotional product 10, the flap 108 is the first portion of the blank 100 to encounter the waste separation station 226, and therefore can be an effective aid in removal of the waste material 110 from the blank 100. The waste separation station 226 may remove the waste material 110 by any means known in the art and rely on any suitable electrical-, mechanical-, pneumatic-, and/or vacuum-based technique. A nonlimiting example of a waste separation station 226 adapted to employ the waste extraction flap 108 to remove the waste material 110 from a blank 100 is represented in FIG. 12. The waste separation station 226 is represented as including the aforementioned hook and lift mechanism 240 similar to those typically used in to cross-fold scored carton ends (perpendicular to product travel direction) into the carton center, that is, a folding carton lock bottom. According to aspects of the invention, the hook and lift mechanism 240 is configured to lift and separate the waste materials 110 of card panels 112 by lifting a leading edge of the blank 100, for example, the waste extraction flap 108, for removal by the waste evacuation system 228. As each waste material 110 is removed, its corresponding card 12 remains adhered to its carrier panel 114. As previously noted, a blank 100 equipped with a waste extraction flap 108 is preferably fed into the system 200 such that, after any flopping of the blank 100, the waste extraction flap 108 defines the leading edge of the blank 100 in the direction of travel when the blank 100 reaches the waste evacuation system 228. As such, the hook and lift mechanism 240 is able to first interact with the waste extraction flap 108 to remove the waste material 110 without disturbing the carrier panels 114 or the cards 12 secured thereto. The hook and lift mechanism 240 may be, for example, a timed physical function resulting from the blank 100 triggering an optic or physical sensor to activate a mechanical hook function, or a spring-loaded return hook mechanism which drags the blanks 100 and snags the leading edge of the waste extraction flap 108 as the blanks 100 are conveyed by tapes, rollers, vacuum table belts, or any other drive methods known in the art.

Figure 11:
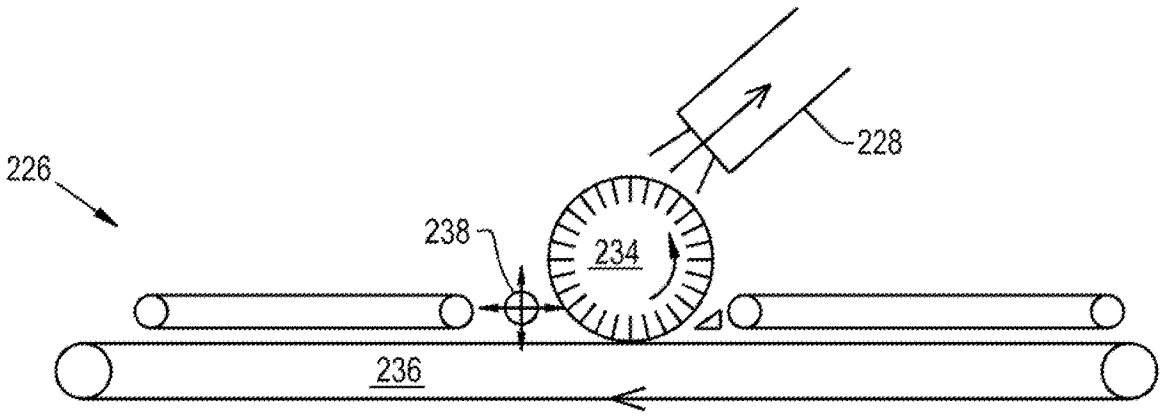
FIGS. 11 and 12 represent exemplary stations that may be used in conjunction with a waste removal station of the system represented in FIG. 5.

Alternatively if the waste extraction flap 108 is not used, any combination of methods known in the art may be used to remove the waste material 110. FIG. 11 represents a nonlimiting example comprising one or more vacuum wheels 234 and one or more vacuum tables 236, for example, a conveyor with a perforated belt through which a vacuum is drawn. In such a configuration, the vacuum table 236 may hold down the carrier panels 114 during removal and air suction extraction of the waste material 110 by the suction wheels 234 and waste evacuation system 228.

Both FIGS. 11 and 12 further represent the waste separation station 226 as including optional pinching or pressing rollers 238 configured to provide a holding pressure to the partially cut-out cards 102 attached to the carrier panels 114 as the waste material 110 are removed. The pinching/pressing rollers 238 may be adjustable in multiple axes, including a vertical direction (up-down) relative to the vacuum table 236 in order to apply pressure to the partially cut-out cards 102 and the carrier panels 114, as well as in a horizontal direction (forward-backward) relative to the direction of travel of the blanks 100.

It is also within the scope of the invention that the waste separation station 226 could be limited to using only the vacuum table 236 and/or adjustable guides or fingers (not shown) to hold the carrier panels 114 down while the waste material 110 are removed. Other known nonlimiting methods include cam style rotary, reciprocating type, and/or pivot gates, all of which may function by means of a motion-phased gearbox/belt/pulley or motorized electronic or pneumatic activation devices cued and activated from any type of optic, electronic, or mechanical position sensors through PLC or relay logic activation for all typical methods known for such timing functions.

After removal of the waste material 110, the products 10 will typically comprise one or more cards 12 secured to one of the carrier panels 114. Any remaining stations of the system 200 may be configured to finish and convert the remainder of the blank 100 from the flat carrier panels 114 into the final promotional product 10. Nonlimiting examples include folding the carrier panels 114 to produce a multi-page promotional product, spot/line gluing or running perforation to enclose the product 10 to meet postal regulations, additional die cutting processes for features such as windows or sculpted edges, on-serting or label additions, and/or running or pattern perforations to enclose the entire promotional product 10 into a "zip" opening format. For example, step 324 in FIG. 6F represents the carrier panels 114 of step 322 (FIG. 6E) as being folded along a scored fold line 106 between the panels 114 to form a four-page promotional product 10. Other foreseeable formats include any conceivable number of lateral or horizontal folds or pagination formats including cross-folding of leading and trailing edge flaps of the blank 100 to create an "iron cross" or an all-sides folding around the card 12.

Processes in accordance with aspects described herein are believed to provide improved economic benefits from improved manufacturing efficiency relative to conventional printing techniques, particularly the web-based printing and finishing techniques represented in FIGS. 2-4. Industry trends for high volume web press printed/inline finished promotional products that have cards secured thereto (including the products 10 of FIGS. 1A-1F) are such that pressure is building for shorter runs and versioning of high quality value-added products. On-serting and personalization of PVC cards is generally not economically reasonable for direct mail retail advertisers, nor is PVC as environmentally friendly as paper. The production of single- and multi-ply promotional products is one of if not the most popular and exciting web press/inline finishing format in stand-alone high volume retail direct mail today. Improved methods of production are being driven by print advertisers and print buyer demand for lower quantities which are not economically viable from web press/inline finishing operations. The clear trend in virtually all printing disciplines today are declining volumes requested by print buyers for a number of reasons, including but not limited to, increasing competition for budgets from newer electronic media, increasing cost to manufacture traditional web printing, increasing costs of postal delivery, higher accuracy of data collection tracking buying habits, demographics and closed loop feedback all due to VDP and data collection. Print advertisers clearly and accurately define and identify their target buyers specifically using available data which reduces need for flood mailings and increases purchase probability and spend from recipient. Data driven target mailings, specified offers based on recipient history and need to reduce overall costs in advertising budgets directly feed the need for methods such as those described herein.

Production costs to operate systems in accordance with aspects of the invention are believed to be much lower compared to conventional web press/inline finishing systems for short to mid-sized run length quantities. In fact, it is generally recognized in the web offset/heat-set direct mail sector that promotional paper card production from web press and finishing specifies low limit manufacture of no less than 200,000 pieces to approach being economically viable due to make-ready time and waste expenditures. Alternative methods for low quantities involve costs to purchase cards separately, separating cards from carriers, costs for additional/multiple printing processes, limited creativity in card placement or design, additional read/write VDP/encoding, slower production output speeds, camera/verification systems, costs, etc., making those alternatives very costly as well. Processes in accordance with preferred aspects of the invention are believed to provide a major economic advantage over conventional printing and card-finishing production methods for printing quantities as low as about 5,000 to 10,000 pieces, with the greatest economic benefits believed to be achieved in printing quantities between about 20,000 to 200,000 pieces.

While the invention has been described in terms of specific embodiments, it is apparent that other forms could be adopted by one skilled in the art. For example, the physical configuration of products produced by processes described herein could differ from the products 10 depicted in the drawings, and the physical configurations of the system 200 and its stations and units could differ from those shown in the drawings, functionally equivalent equipment could be substituted for the units and equipment described, and materials and processes other than those noted could be used. Therefore, the scope of the invention is to be limited only by the following claims.

The invention claimed is:

1. A finishing process performed entirely on a folder/gluer line comprising a feeder unit, a turnover unit, at least one folding station comprising a plow folding device, at least one gluer unit, and a slitting station to convey a single, individual contiguous blank consisting of a single material through the folder/gluer line and perform thereon folding, gluing, slitting, and shingling/stacking operations to manufacture a finished, mail-ready product comprising a single-page or multi-page carrier and at least one card secured thereto so that the carrier and the card of the finished mail-ready product are entirely formed by regions of the blank consisting of the single material and comprising at least one carrier panel and at least one card panel with a fold line therebetween, the process comprising printing text and/or images on a sheet, die cutting the sheet to create the blank and create a partial cutout portion in the card panel such that the partial cutout portion remains partially attached to the card panel and a remaining portion of the card panel surrounds the partial cutout portion, and while the blank is conveyed through the folder/gluer line: turning the blank over with the turnover unit, using the gluer unit to apply glue to the partial cutout portion on the card panel or to the carrier panel at a location aligned with the partial cutout portion on the card panel, using the plow folding device of the folding station to fold the blank at the fold line to form a spine between the card panel and carrier panel and to adhere the partial cutout portion of the card panel to the carrier panel with the glue, detaching the remaining portion from the partial cutout portion by removing the spine with the slitting station so that the partial cutout portion of the card panel is the only part of the card panel that remains attached to the carrier panel, removing the remaining portion from the card panel as waste material so that only the partial cutout portion of the card panel remains attached to the carrier panel as the card adhered to the carrier panel, and finishing the blank to form the finished, mail-ready product in which the carrier panel defines at least a portion of the carrier of the finished, mail-ready product and the card is secured to the carrier panel, wherein the partial cutout portion is created in the card panel by the die cutting of the blank before the steps of using the gluer unit and the folding station of the folder/gluer line, and wherein the carrier and the card of the finished, mail-ready product are produced entirely from the single material of the blank, except for the card there is no residual evidence of the card panel on the finished mail-ready product, the card consists of the single material, and the card is never physically separated from the blank throughout the process.

2. The finishing process of claim 1, the process further comprising printing personalized data and/or an image on any of the card, the carrier, the card panel and the carrier panel using a variable data printing technique.

3. The finishing process of claim 1, further comprising:

forming the card to comprise at least two plies; and placing information tracking means, a digital tag, a near field communication (NFC) device, and/or a radio frequency identification device (RFID) within the at least two plies of the card and/or within the carrier.

4. The finishing process of claim 1, wherein the folder/gluer line comprises a hook and lift mechanism and the remaining portion is removed from the card panel by using the hook and lift mechanism to engage a waste extraction flap of the first remaining portion that protrudes beyond the carrier panel.

5. The finishing process of claim 1, further comprising mailing the finished mail-ready product to an end user wherein the finished mail-ready product comprises the card attached to the carrier but is free of any remnants of the card panel.

6. The finishing process of claim 1, further comprising:

printing personalized data on the card, the carrier, or both the card and the carrier on a first side of the blank;

flipping over the blank within the folder/gluer line and after printing the personalized data on the first side of the blank; and printing personalized data on the card, the carrier, or both the card and the carrier on a second side of the blank.

7. The finishing process of claim 1, wherein the finished, mail-ready product is a direct mail promotional product.

8. The finishing process of claim 1, wherein the finished, mail-ready product is a trading card, a playing card, a game card, or a greeting card.

9. The finishing process of claim 1, wherein the remaining portion of the card panel is not secured with the adhesive to the carrier panel following the folding of the card panel over the carrier panel.

10. The finishing process of claim 1, wherein the blank comprises at least a second carrier panel contiguous with the carrier panel and having a second fold line therebetween, the process further comprising folding the carrier panel over and onto the second carrier panel so that the card is between the carrier panel and second carrier panel.

11. The finishing process of claim 1, wherein the card panel is a first card panel and the blank comprises a second card panel contiguous with the first card panel and having a second fold line therebetween, the process further comprising:

prior to folding the first card panel over and onto the carrier panel, folding the second card panel over and onto the first card panel such that the second card panel is secured to the first card panel with an adhesive, and performing the step of removing the remaining portion of the first card panel so that the remaining portion of the first card panel and a second remaining portion of the second card panel are respectively separated from the partial cutout card of the first card panel and from a second partial cutout card of the second card panel and only the partial cutout card of the first card panel and the second partial cutout card of the second card panel remain secured to the carrier panel and define at least a portion of the card of the finished mail-ready product, wherein the card comprises at least two plies of the paper material, a first of the plies is the partial cutout card of the first card panel, and a second of the plies is the second partial cutout card of the second card panel that is secured to the partial cutout card of the first card panel with the adhesive.

12. The process of claim 11, wherein the blank comprises a third card panel contiguous with the second card panel and having a third fold line therebetween, the process further comprising folding the third card panel over and onto the second card panel prior to folding the second card panel over and onto the first card panel such that the first, second and third card panels are secured together with an adhesive, wherein the card comprises at least three plies including a ply formed by a third partial cutout card of the third card panel.

13. A finishing process performed entirely on a folder/gluer line comprising at least a first folding station, at least a first gluer unit, a hook and lift mechanism, and at least a mid-line rotary die cutter to manufacture a finished, mail-ready product comprising a carrier and at least one card secured thereto so that the carrier and the card of the finished mail-ready product are entirely formed by regions of a single, individual contiguous blank consisting of a paper material and comprising at least a first carrier panel and at least a first card panel with a fold line therebetween, the processing being performed on the folder/gluer line so that the carrier and the card are never physically separated or out of contact with the blank or with one another throughout the process, the process comprising printing text and/or images on a sheet, cutting the sheet to create the blank, and while the blank is conveyed through the folder/gluer line:

using the mid-line rotary die cutter to cut the first card panel to at least partially define a first partial cutout card therein such that the first partial cutout card remains partially attached to the first card panel and a first remaining portion of the first card panel surrounds the first partial cutout card;

using the first gluer unit to apply glue to the first partial cutout card on the first card panel or to the first carrier panel at a location aligned with the first partial cutout card on the first card panel, using the first folding station to fold the first card panel over and onto the first carrier panel such that a spine is formed between the first card panel and the first carrier panel and the first partial cutout card is secured to the first carrier panel with the glue;

performing a slitting operation on the first card panel to detach the first remaining portion from the first partial cutout card by removing the spine so that the first partial cutout card is the only part of the first card panel that remains attached to the first carrier panel;

removing the first remaining portion of the first card panel as waste material so that the first remaining portion is separated from the first partial cutout card, only the first partial cutout card remains secured to the first carrier panel and defines at least a portion of the card of the finished, mail-ready product, and the first carrier panel defines at least a portion of the carrier of the finished, mail-ready product, wherein the first remaining portion is removed from the first card panel by using the hook and lift mechanism to engage a leading edge of the first remaining portion that protrudes beyond the first carrier panel; and finishing the blank to form the finished, mail-ready product in which the card is secured to the carrier;

wherein the card and the carrier of the finished, mail-ready product are produced entirely from the paper material of the blank, except for the card there is no residual evidence of the card panel on the finished mail-ready product, the card consists of the paper material, and the card is never physically separated from the blank throughout the process.

14. The finishing process of claim 13, wherein the first remaining portion of the first card panel is not secured with the adhesive to the first carrier panel following the folding of the first card panel over the first carrier panel.

15. The finishing process of claim 13, wherein the blank comprises at least a second carrier panel contiguous with the first carrier panel and having a second fold line therebetween, the process further comprising folding the first carrier panel over and onto the second carrier panel so that the card is between the first and second carrier panels.

16. The finishing process of claim 13, wherein the blank comprises a second card panel contiguous with the first card panel and having a second fold line therebetween, the process further comprising:

prior to folding the first card panel over and onto the first carrier panel, folding the second card panel over and onto the first card panel such that the second card panel is secured to the first card panel with an adhesive, and performing the step of removing the first remaining portion of the first card panel so that the first remaining portion of the first card panel and a second remaining portion of the second card panel are respectively separated from the first partial cutout card of the first card panel and from a second partial cutout card of the second card panel and only the first and second partial cutout cards remain secured to the first carrier panel and define at least a portion of the card of the finished mail-ready product, wherein the card comprises at least two plies of the paper material, a first of the plies is the first partial cutout card of the first card panel, and a second of the plies is the second partial cutout card of the second card panel that is secured to the first partial cutout card with the adhesive.

17. The finishing process of claim 16, wherein the blank comprises a third card panel contiguous with the second card panel and having a third fold line therebetween, the process further comprising folding the third card panel over and onto the second card panel prior to folding the second card panel over and onto the first card panel such that the first, second and third card panels are secured together with an adhesive, wherein the card comprises at least three plies including a ply formed by a third partial cutout card of the third card panel.

18. The finishing process of claim 16, wherein the process places information tracking means, a digital tag, a near field communication (NFC) device, and/or a radio frequency identification device (RFID) within the card between the two plies of the paper material.

19. The finishing process of claim 16, wherein the leading edge of the first remaining portion is a waste extraction flap.

20. The finishing process of claim 16, wherein the mid-line rotary die cutter makes a kiss-cut, and the blank is cut with the mid-line rotary die cutter after the steps of using the first gluer unit and the first folding station by cutting through the first and second card panels and leaving the first carrier panel uncut.

21. The finishing process of claim 17, wherein the process places information tracking means, a digital tag, a near field communication (NFC) device, and/or a radio frequency identification device (RFID) within the card between the plies of the paper material.

22. The finishing process of claim 17, wherein the first, second and third card panels are all simultaneously cut by the mid-line rotary die cutter to simultaneously at least partially define the first, second and third partial cutout cards.

23. The finishing process of claim 13, wherein the mid-line rotary die cutter makes a kiss-cut, and the blank is cut with the mid-line rotary die cutter after the steps of using the gluer unit and the folding station by cutting through the card panel and leaving the carrier panel uncut.

24. The finishing process of claim 1, wherein the single material of the blank is a paper material and the card consists of the paper material.

25. The finishing process of claim 13, further comprising printing personalized data and/or an image on at least one of the card, the carrier, the first card panel and the first carrier panel using a variable data printing technique.

26. The finishing process of claim 13, further comprising:

printing personalized data on the card, the carrier, or both the card and the carrier on a first side of the blank;

flipping over the blank within the folder/gluer line and after printing the personalized data on the first side of the blank; and printing personalized data on the card, the carrier, or both the card and the carrier on a second side of the blank.

27. The finishing process of claim 13, wherein the finished, mail-ready product is a direct mail promotional product.

28. The finishing process of claim 13, wherein the finished, mail-ready product is a trading card, a playing card, a game card, or a greeting card.

29. The finishing process of claim 13, wherein the leading edge of the first remaining portion is a waste extraction flap.

30. The finishing process of claim 13, further comprising mailing the finished mail-ready product to an end user wherein the finished mail-ready product comprises the card attached to the carrier but is free of any remnants of the first card panel.

31. The finishing process of claim 13, further comprising:

forming the card to comprise at least two plies; and placing information tracking means within the at least two plies of the card and within the carrier.

* * * * *